US011280160B2

(12) United States Patent
Calahan et al.

(10) Patent No.: US 11,280,160 B2
(45) Date of Patent: Mar. 22, 2022

(54) MULTI-ZONE HYDRAULIC STIMULATION SYSTEM

(71) Applicant: NATIONAL OILWELL VARCO, L.P., Houston, TX (US)

(72) Inventors: Sean Calahan, Houston, TX (US); Aju Abraham, Houston, TX (US); David Nowowiejski, Houston, TX (US); Chris Shewchuk, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 16/767,861

(22) PCT Filed: Nov. 29, 2018

(86) PCT No.: PCT/US2018/063034

§ 371 (c)(1),
(2) Date: May 28, 2020

(87) PCT Pub. No.: WO2019/108776

PCT Pub. Date: Jun. 6, 2019

(65) Prior Publication Data

US 2021/0002982 A1 Jan. 7, 2021

Related U.S. Application Data

(60) Provisional application No. 62/591,906, filed on Nov. 29, 2017.

(51) Int. Cl.
*E21B 34/14* (2006.01)

(52) U.S. Cl.
CPC ..... *E21B 34/142* (2020.05); *E21B 2200/06* (2020.05)

(58) Field of Classification Search
CPC ..... E21B 34/14; E21B 34/142; E21B 2200/06
See application file for complete search history.

(56) References Cited

U.S. PATENT DOCUMENTS

2006/0124310 A1* 6/2006 Lopez de Cardenas ..... E21B 43/08 166/313
2013/0175033 A1* 7/2013 Baihly ..... E21B 34/14 166/284

(Continued)

OTHER PUBLICATIONS

International Search Report and Written Opinion dated Apr. 29, 2019, for Application No. PCT/US2018/063034.

*Primary Examiner* — Christopher J Sebesta
(74) *Attorney, Agent, or Firm* — Conley Rose, P.C.

(57) ABSTRACT

A system includes a string disposed in a wellbore, a first valve coupled to the string, the first valve including a sleeve having an engagement profile with a first coded sequence, a second valve coupled to the string, the second valve including a sleeve having an engagement profile with a second coded sequence that differs from the first coded sequence of the first valve, and a first dart flow transportable through the string, the first dart including a collet finger having a first coded sequence configured to restrict the collet finger from matingly engaging the engagement profile of the first valve while permitting the collet finger to engage the engagement profile of the second valve, wherein the first dart actuates the sleeve of the second valve between first and second positions in response to the collet finger of the first dart matingly engaging the engagement profile of the second valve.

18 Claims, 19 Drawing Sheets

(56) References Cited

U.S. PATENT DOCUMENTS

| | | | | |
|---|---|---|---|---|
| 2013/0206402 | A1* | 8/2013 | Coon | E21B 43/14 166/255.1 |
| 2015/0361747 | A1* | 12/2015 | Lafferty | E21B 34/14 166/373 |
| 2016/0053585 | A1* | 2/2016 | Cochran | E21B 34/14 166/237 |
| 2016/0258260 | A1* | 9/2016 | Walton | E21B 33/13 |
| 2017/0175488 | A1 | 6/2017 | Lisowski et al. | |

* cited by examiner

MULTI-ZONE HYDRAULIC STIMULATION SYSTEM

CROSS-REFERENCE TO RELATED APPLICATIONS

This application is a U.S.C § 371 national stage application of PCT/US2018/063034 filed Nov. 29, 2018, entitled "Multi-Zone Hydraulic Stimulation System," which claims benefit of U.S. provisional patent application Ser. No. 62/591,906 filed Nov. 29, 2017, and entitled "Multi-Zone Hydraulic Stimulation System," both of which are hereby incorporated herein by reference in their entirety.

STATEMENT REGARDING FEDERALLY SPONSORED RESEARCH OR DEVELOPMENT

Not applicable.

BACKGROUND

In drilling a borehole into an earthen formation, such as for the recovery of hydrocarbons or minerals from a subsurface formation, it is typical practice to connect a drill bit onto the lower end of a drillstring formed from a plurality of pipe joints connected end-to-end, and then rotate the drillstring so that the drill bit progresses downward into the earth to create a borehole along a desired trajectory. In some applications, the borehole may be drilled in a plurality of stages, where, following the drilling of each stage, a casing or production liner joint is installed within the drilled borehole, and cement is pumped in the annulus existing between the outer surface of the casing joint and the inner surface of the borehole. After the pumped cement has set or cured, the inner surface of the section of cased borehole is isolated from fluids disposed within a central passage of the borehole. Additionally, in some applications, each subsequently installed casing or liner joint may be physically supported or anchored from the precedingly installed casing or liner joint, forming a casing or liner string in the borehole.

In at least some applications, when the final stage of the borehole is drilled, a final casing or liner joint is installed at a terminal end of the borehole, and the annulus surrounding the final casing or liner joint, as well as the terminal end of the borehole, is cemented to thereby isolate or seal the inner surface of the borehole from fluid disposed in the central passage thereof. In applications having a horizontal or deviated borehole, the terminal end of the borehole may be referred to as the "toe" of the borehole. In certain applications, once the drilled borehole has been successfully cased and cemented, the formation may be stimulated using a stimulation fluid. For instance, in some applications, the formation is hydraulically fractured to provide for controlled fluid communication between the formation and the central passage of the borehole. For instance, the casing or liner string may include a number sliding sleeve valves (e.g., actuated by the dropping of various sized balls into the borehole) for providing selective fluid communication between the formation and the central passage of the casing or liner string.

SUMMARY OF THE DISCLOSURE

An embodiment of a system for stimulating an earthen formation comprises a tubular string disposed in a wellbore extending through the formation, a first valve coupled to the tubular string, the first valve comprising a sliding sleeve having an engagement profile with a first coded sequence, a second valve coupled to the tubular string, the second valve comprising a sliding sleeve having an engagement profile with a second coded sequence that differs from the first coded sequence of the first valve, and a first dart flow transportable through the tubular string, the first dart comprising a collet finger having a first coded sequence configured to restrict the collet finger from matingly engaging the engagement profile of the first valve while permitting the collet finger to matingly engage the engagement profile of the second valve, wherein the first dart is configured to actuate the sliding sleeve of the second valve from a first position to a second position in response to the collet finger of the first dart matingly engaging the engagement profile of the second valve. In some embodiments, the system further comprises a second dart flow transportable through the tubular string, the second dart comprising a collet finger having a second coded sequence that differs from the first coded sequence of the first dart and configured to permit the collet finger to matingly engage the engagement profile of the first valve, wherein the second dart is configured to actuate the sliding sleeve of the first valve from a first position to a second position in response to the collet finger of the second dart matingly engaging the engagement profile of the first valve. In some embodiments, the engagement profile of the sliding sleeve of the second valve comprises a locking groove and the collet finger of the first dart comprises a locking shoulder, the locking groove and the locking shoulder being configured to axially lock the first dart to the sliding sleeve of the second valve after the sliding sleeve of the second valve has actuated to the second position. In certain embodiments, the engagement profile of the sliding sleeve of both the first valve and the second valve comprises a plurality of axially spaced coding grooves, the first valve comprises a first blocking member disposed in one of the coding grooves of the engagement profile of the sliding sleeve of the first valve, and the second valve comprises a second blocking member disposed in one of the coding grooves of the engagement profile of the sliding sleeve of the first valve. In some embodiments, a plurality of axially spaced keyways are disposed on an outer surface of the collet finger of the first dart, at least one key is received in one of the keyways of the collet finger, the at least one key of the first dart axially overlaps the blocking member of the first valve when the keyways of the collet finger of the first dart are axially aligned with the coding grooves of the sliding sleeve of the first valve, preventing mating engagement between the collet finger of the first dart and the engagement profile of the first valve, and the at least one key of the first dart is axially spaced from the blocking member of the second valve when the keyways of the collet finger of the first dart are axially aligned with the coding grooves of the sliding sleeve of the second valve, permitting mating engagement between the collet finger of the first dart and the engagement profile of the second valve. In some embodiments, the first dart comprises a pair of elongate retaining members extending along a pair of sides of the collet finger, and a plurality of fasteners releasably coupling the retaining members to the collet finger, wherein the retaining members releasably couple the at least one key to the collet finger. In certain embodiments, the sliding sleeve of the second valve comprises a first protective groove located at a first end of the engagement profile, a second protective groove located at a second end of the engagement profile opposite the first end, and a locking groove located between the first protective groove and the second protective groove. In certain embodiments, the first dart comprises a pair of axially spaced protective shoulders extending radially outward from the collet finger, wherein the protective shoulders are configured to be received in the first and second protective grooves of the sliding sleeve of the second valve, and a locking shoulder extending radially outward from the collet finger, wherein the locking shoulder is located between the pair of protective shoulders, wherein the locking shoulder is configured to be received in the locking groove of the sliding sleeve of the second valve. In some embodiments, the first dart comprises a nose coupled to a first end of the collet, an entry guide coupled to a second end of the collet opposite the first end, the entry guide configured to guide the dart through the wellbore, and an annular seal disposed on an outer surface of the collet and configured to seal against a sealing surface disposed in the wellbore, wherein the nose and entry guide are formed from dissolvable materials configured to dissolve in response to a predetermined environmental condition within the wellbore.

An embodiment of a sliding sleeve valve for use in a wellbore comprises an outer housing, a sliding sleeve slidably disposed in the outer housing, the sliding sleeve comprising an engagement profile formed on an inner surface thereof, wherein the engagement profile comprises a plurality of axially spaced coding grooves, and at least one blocking member configured to be received in one of the coding grooves of the sliding sleeve, wherein the engagement profile is configured to form a coded sequence when the at least one blocking member is received in one of the coding grooves of the sliding sleeve, and wherein the sliding sleeve is configured to actuate from a first position to a second position in response to an actuation tool matingly engaging the engagement profile of the sliding sleeve. In some embodiments, the at least one blocking member comprises at least one blocking ring molded to one of the coding grooves of the sliding sleeve. In some embodiments, the engagement profile of the sliding sleeve further comprises a first protective groove located at a first end of the engagement profile, a second protective groove located at a second end of the engagement profile opposite the first end, and a locking groove located between the first protective groove and the second protective groove. In certain embodiments, the sliding sleeve valve further comprises a protective sleeve disposed at least partially in the sliding sleeve, wherein the protective sleeve has a first position relative to the sliding sleeve covering the coding grooves of the engagement profile and a second position relative to the sliding sleeve axially spaced from the coding grooves. In certain embodiments, the outer housing comprises a radial port, the sliding sleeve comprises a pair of annular seals disposed on an outer surface thereof, and the annular seals of the sliding sleeve seal a passage of the outer housing from an environment surrounding the sliding sleeve valve when the sliding sleeve is in the first position and permit fluid communication between the passage of the outer housing and the environment surrounding the sliding sleeve when the sliding sleeve is in the second position.

An embodiment of a dart flow transportable through a wellbore comprises a collet, a collet finger coupled to the collet, a plurality of axially spaced keyways disposed on an outer surface of the collet finger, and at least one key configured to be received in one of the keyways of the collet finger, wherein the collet is configured such that when the at least one key is received in one of the keyways of the collet finger, the collet finger forms a coded sequence. In some embodiments, the collet comprises a plurality of circumferentially spaced collet fingers, each collet finger comprising a plurality of axially spaced keyways disposed on an outer surface of the collet finger, one keyway of each collet finger receives one of the at least one keys. In some embodiments, the dart further comprises a pair of elongate retaining members extending along a pair of sides of the collet finger, and a plurality of fasteners releasably coupling the retaining members to the collet finger, wherein the retaining members releasably couple the at least one key to the collet finger. In some embodiments, the plurality of keyways of the collet finger comprise arcuate keyways, and the at least one key comprises an arcuate key. In certain embodiments, the dart further comprises a nose coupled to a first end of the collet, an entry guide coupled to a second end of the collet opposite the first end, the entry guide configured to guide the dart through the wellbore, and an annular seal disposed on an outer surface of the collet and configured to seal against a sealing surface disposed in the wellbore, wherein the nose and entry guide are formed from dissolvable materials configured to dissolve in response to a predetermined environmental condition within the wellbore. In some embodiments, the dart further comprises a pair of axially spaced protective shoulders extending radially outward from the collet finger, and a locking shoulder extending radially outward from the collet finger, wherein the locking shoulder is located between the pair of protective shoulders.

BRIEF DESCRIPTION OF THE DRAWINGS

For a detailed description of disclosed exemplary embodiments, reference will now be made to the accompanying drawings in which.

DETAILED DESCRIPTION OF DISCLOSED EXEMPLARY EMBODIMENTS

Figure 1:
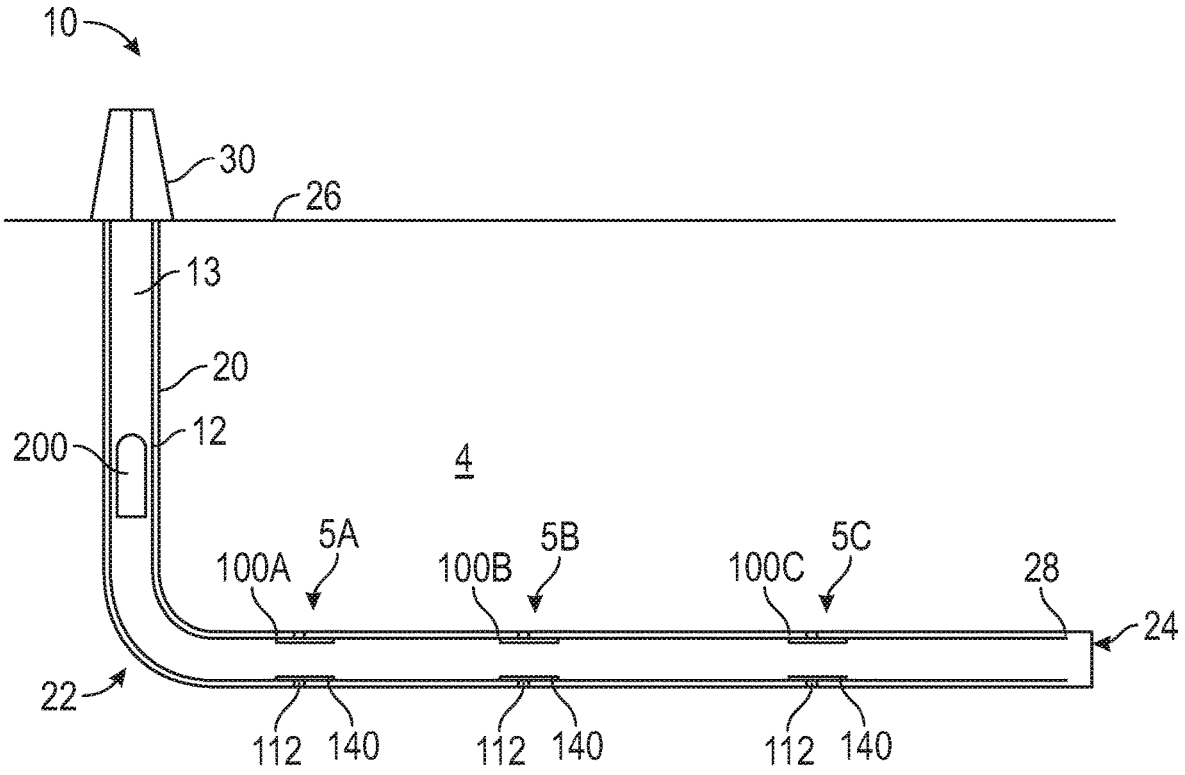
FIGS. 1 and 2 are schematic views of a system for completing a wellbore in accordance with principles disclosed herein.

The following discussion is directed to various embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection as accomplished via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

Figure 2:
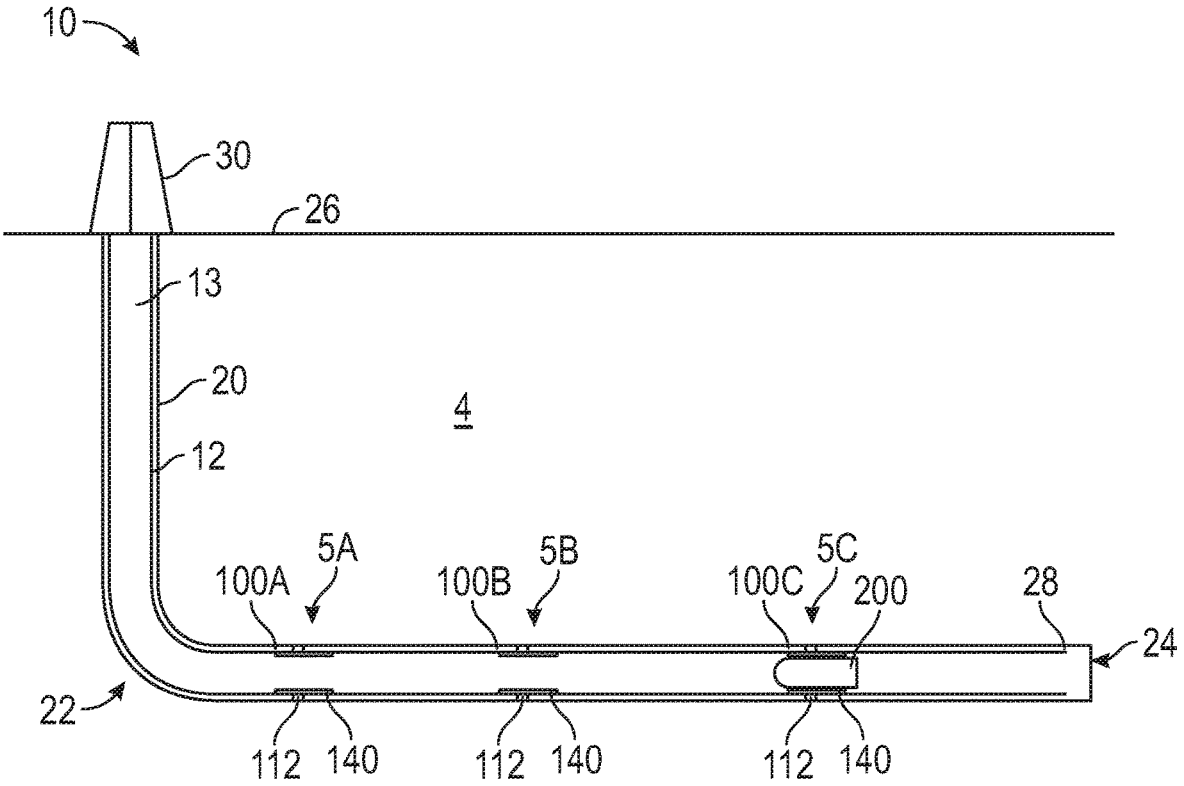
Figure 3:
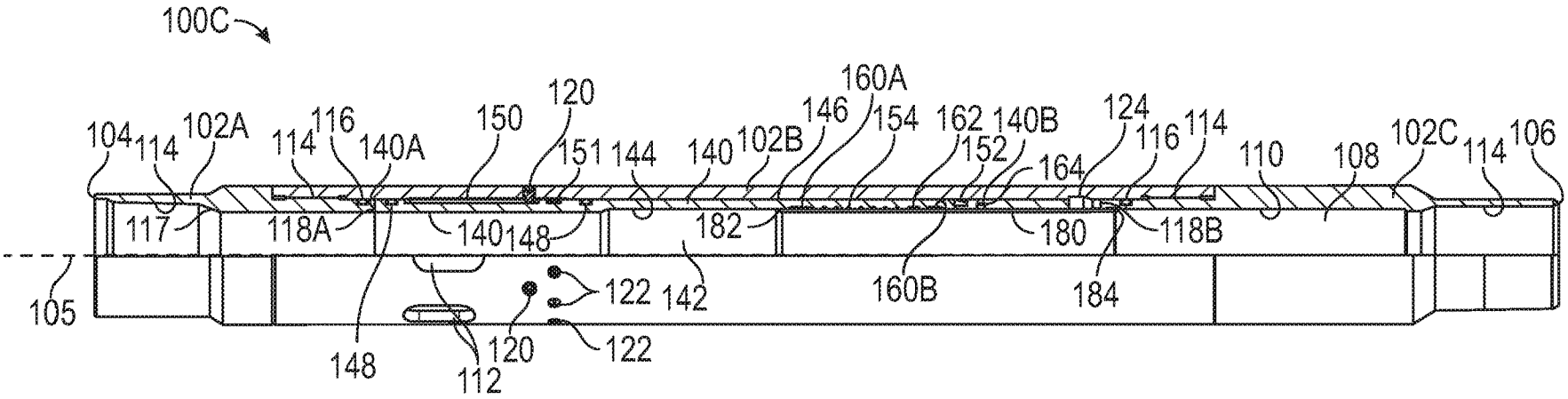
FIG. 3 is a side view of an embodiment of a sliding sleeve valve of the system of FIGS. 1, 2 in accordance with principles disclosed herein.
Figure 4:
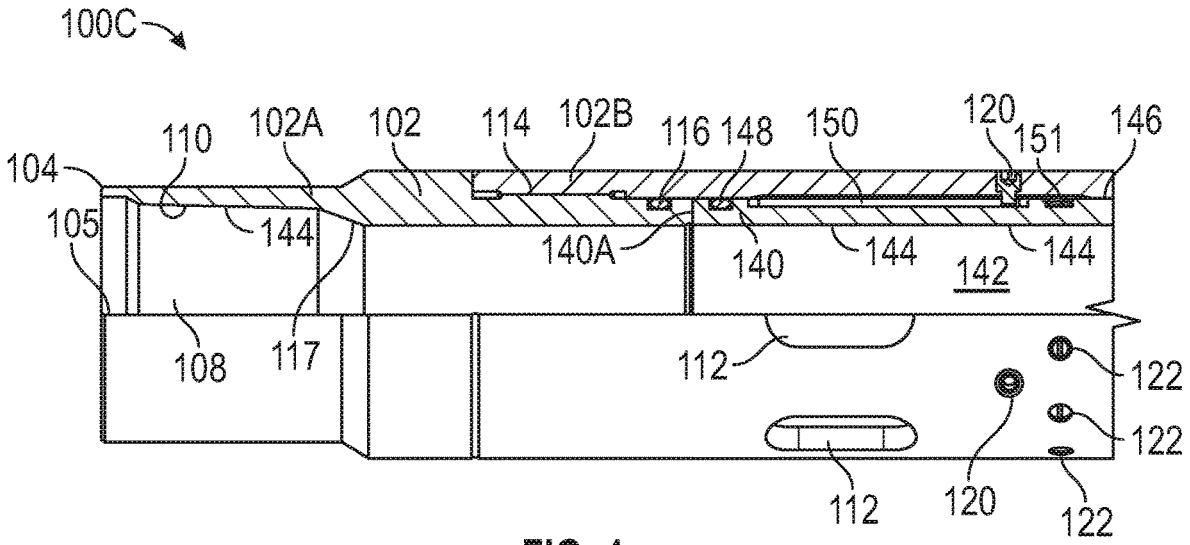
FIG. 4 is a side cross-sectional view of an upper section of the sliding sleeve valve of FIG. 3.
Figure 5:
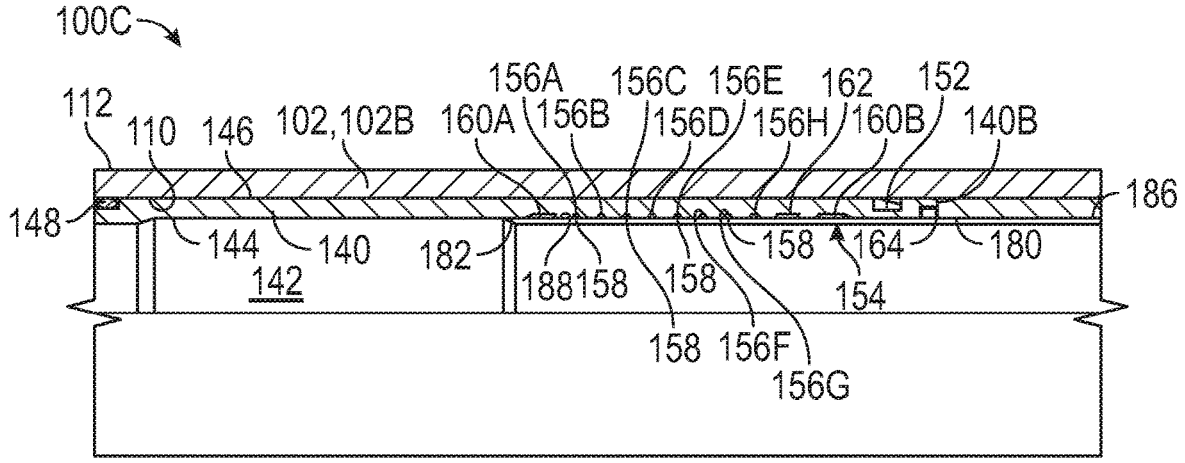
FIG. 5 is a side cross-sectional view of an intermediate section of the sliding sleeve valve of FIG. 3.
Figure 6:
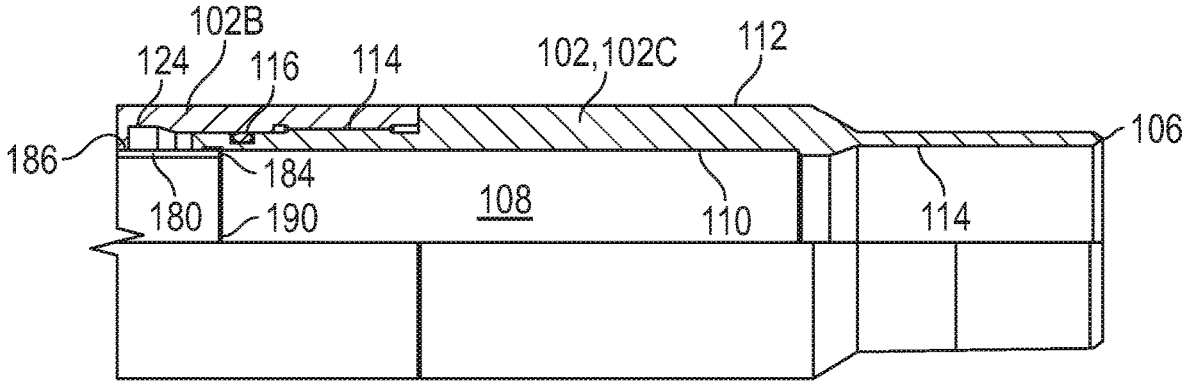
FIG. 6 is a side cross-sectional view of a lower section of the sliding sleeve valve of FIG. 3.
Figure 7:
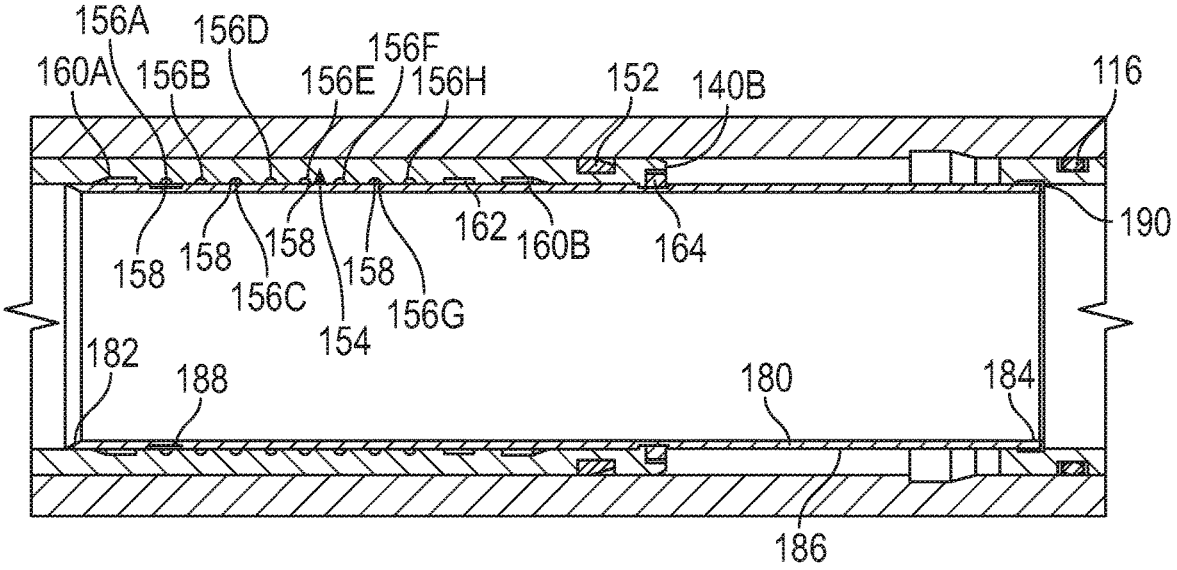
FIG. 7 is a side cross-sectional view of an embodiment of an engagement profile of the sliding sleeve valve of FIG. 3 in accordance with principles disclosed herein.
Figure 8:
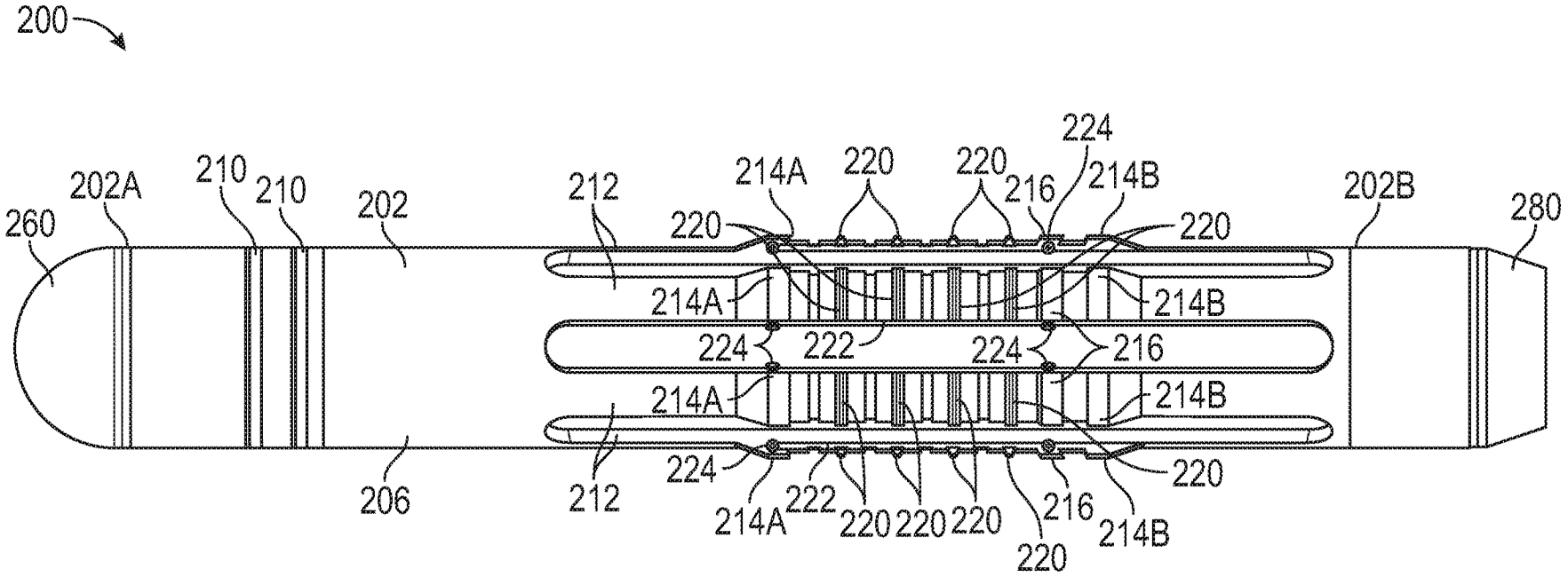
FIG. 8 is a side view of an embodiment of a flow transportable dart of the system of FIGS. 1, 2 in accordance with principles disclosed herein.
Figure 9:
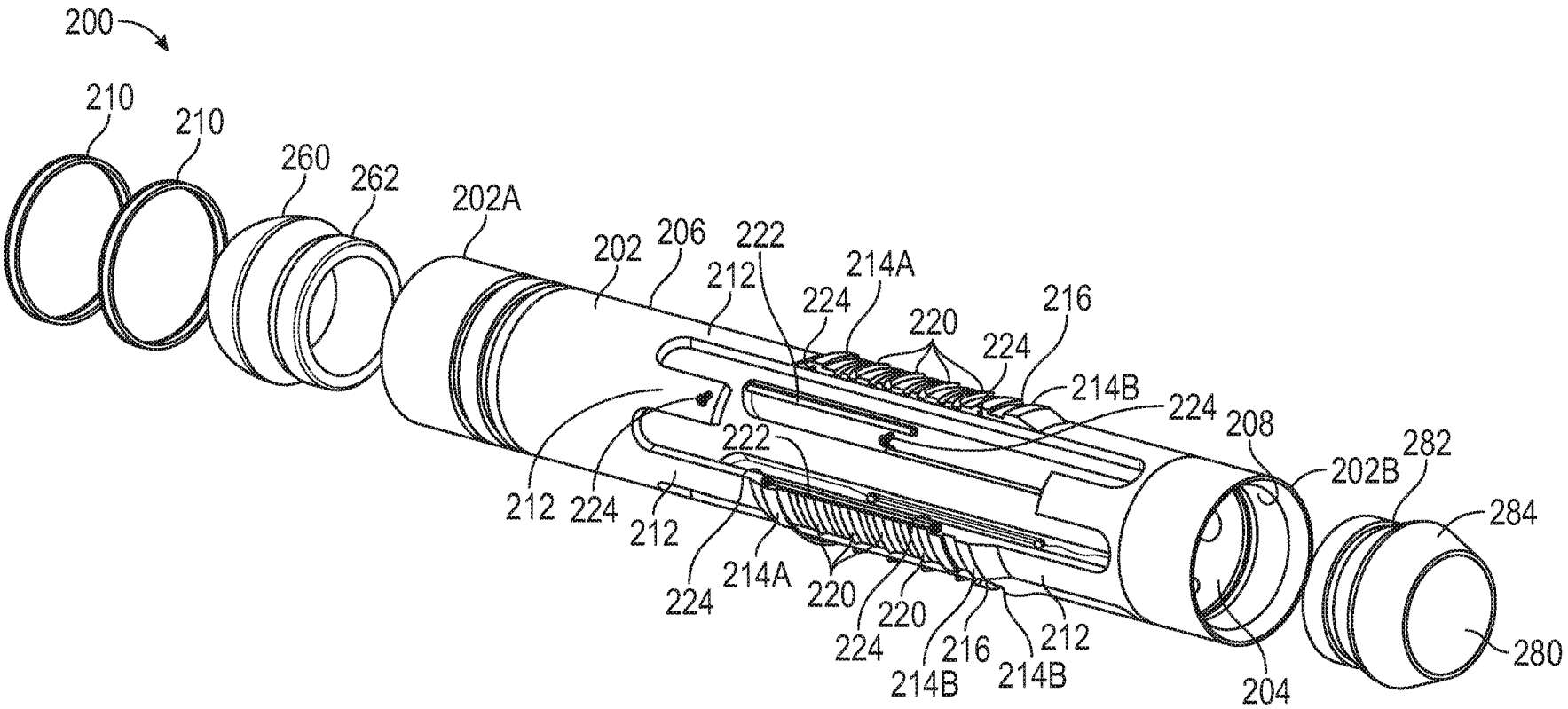
FIG. 9 is an exploded perspective view of the dart of FIG. 8
Figure 10:
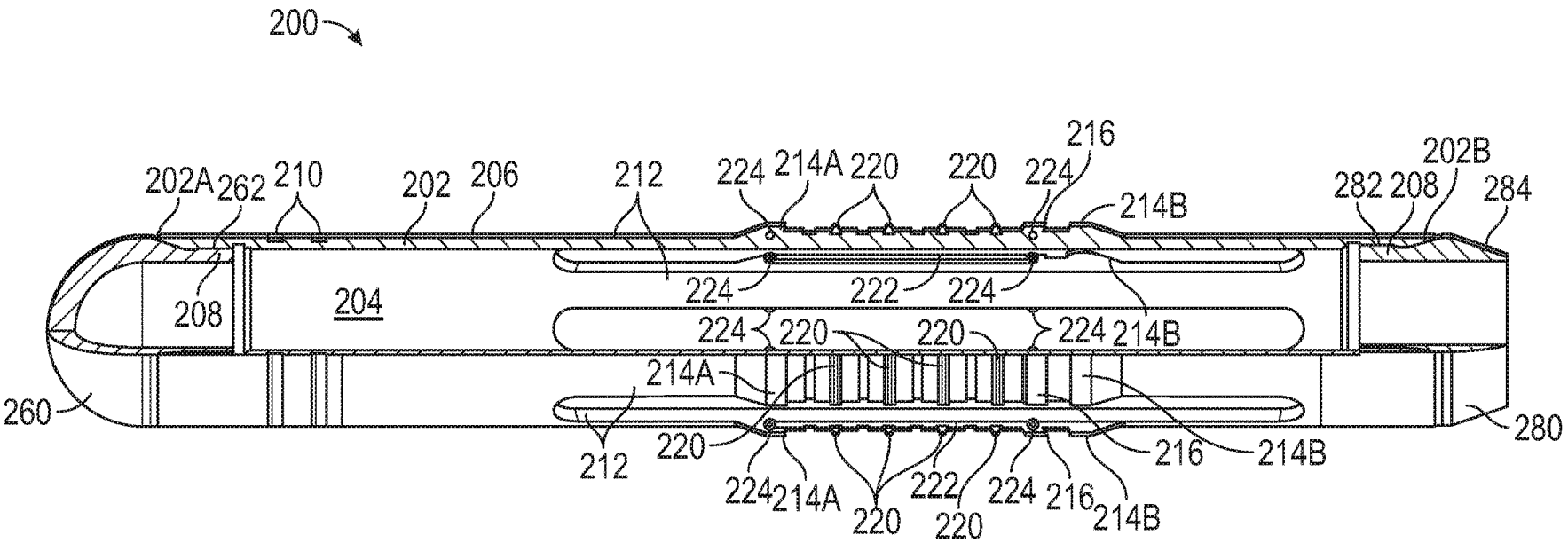
FIG. 10 is a side cross-sectional view of the dart of FIG. 8.
Figure 11:
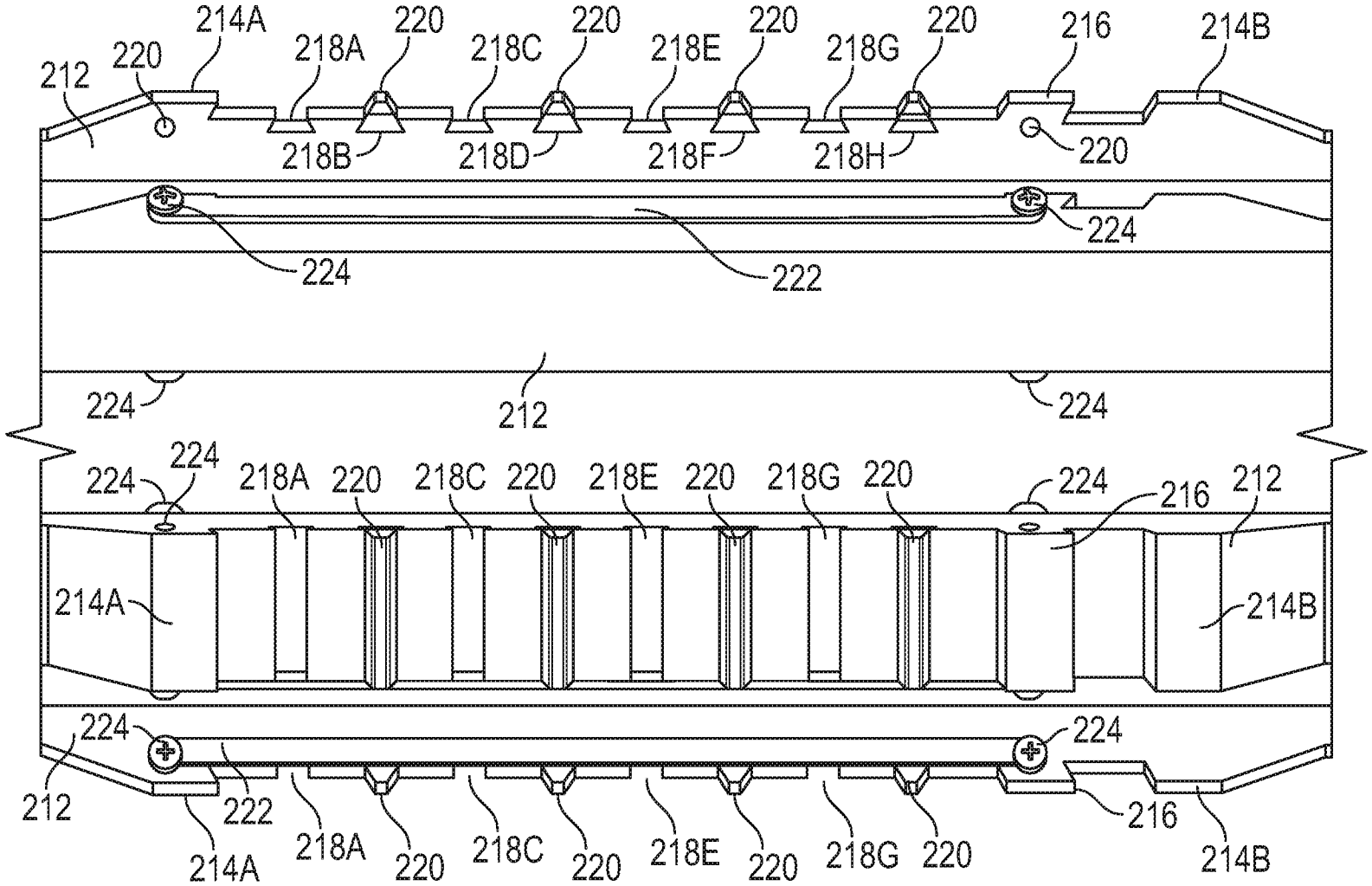
FIG. 11 is a cross-sectional view of an embodiment of a collet finger of the dart of FIG. 8 in accordance with principles disclosed herein.

Referring to FIGS. 1 and 2, a system 10 for completing a wellbore 20 extending through an earthen subterranean formation 4 is shown. In the embodiment of FIGS. 1 and 2, wellbore 20 extends through one or more production zones 5A, 5B, and 5C of subterranean formation 4. In some embodiments, system 10 comprises a system for stimulating (e.g., hydraulic fracturing, etc.) subterranean formation 4. System 10 includes a tubular or casing string 12 comprising a plurality of casing joints, couplings, and sliding sleeve valves 100. For clarity, a first sliding sleeve valve 100 of casing string 12 positioned adjacent production zone 5A is labeled as sliding sleeve valve 100A in FIGS. 1, 2, a second sliding sleeve valve 100 of casing string 12 positioned adjacent production zone 5B is labeled as sliding sleeve valve 100B in FIGS. 1, 2, and a third sliding sleeve vale 100 of casing string 12 positioned adjacent production zone 5C is labeled as sliding sleeve valve 100C in FIGS. 1, 2. Although in this embodiment casing string 12 includes three sliding sleeve valves 100A-100C, in other embodiments, casing string 12 may include varying numbers of sliding sleeve valves 100, including a single sliding sleeve valve 100. Further, while in this embodiment sliding sleeve valves 100A-100C form a part of casing string 12, in other embodiments, one or more sliding sleeve valves 100 may be coupled to or comprise a portion of other tubular member disposed in wellbores.

In this embodiment, each sliding sleeve valve 100A-100C includes a sliding sleeve or closure member 140 having a first or closed position and a second or open position axially spaced from the closed position. Additionally, each sliding sleeve valve 100A-100C includes one or more radial ports 112 configured to provide sleeve fluid communication between a central bore or passage 13 of casing string 12 and the formation 4. Particularly, when the sliding sleeve 140 of the sliding sleeve valve 100 (e.g., any of sliding sleeve valves 100A-100C) is in the closed position, fluid communication between passage 13 and formation 4 via ports 112 of the sliding sleeve valve 100 is restricted. Conversely, when the sliding sleeve 140 of the sliding sleeve valve 100 is in the open position, fluid communication between passage 13 and formation 4 via ports 112 of the sliding sleeve 100 is permitted. FIG. 1 illustrates completion system 10 prior to the actuation of sliding sleeve valves 100A-100C with the sliding sleeve 140 of each sliding sleeve valve 100A-100C disposed in the closed position.

In this embodiment, wellbore 20 comprises a nonvertical or deviated wellbore 20 including a heel 22 and a toe 24 at a lower or downhole end of wellbore 20 that is laterally spaced from heel 22 relative to a surface 26 of wellbore 20. In some embodiments, casing string 12 is made up at the surface 26 and is then lowered into the wellbore 20 from a surface rig or platform 30 disposed at the surface 26 until the desired measured depth is reached so that sliding sleeve valves 100A-100C are disposed adjacent production zones 5A-5C, respectively. In this embodiment, zonal isolation is accomplished by pumping cement towards the toe 24 of wellbore 20 and back towards the surface 26 via an annulus 28 formed between an outer surface of casing string 12 and an inner surface of wellbore 20; however, in other embodiments, zonal isolation may be accomplished by positioning a plurality of annular packers in wellbore 20 to seal against the inner surface of wellbore 20.

In this embodiment, completion system 10 includes one or more untethered, flow transportable darts or actuation tools 200 configured to selectively actuate one of the sliding sleeve valves 100A-100C of casing string 12 from a closed position to an open position. As used herein, the term "flow transportable dart" encompasses any object that may be pumped through a wellbore or transmitted via fluid flow and used to cause movement of a tool or device disposed in the wellbore. As will be discussed further herein, dart 200 may be configured by personnel of completion system 10 to actuate a predetermined sliding sleeve valve 100A-100C from the closed position to the open position. FIG. 1 depicts completion system 10 following the installation of casing string 12 in wellbore 20 and the insertion of dart 200 into passage 13 of casing string 12. FIG. 2 depicts completion system 10 after dart 200 has passed through sliding sleeve valves 100A, 100B, and has landed against and actuated third sliding sleeve valve 100C from a closed position to the open position.

In the position shown in FIG. 2, third sliding sleeve valve 100C is in the open position while sliding sleeve valves 100A, 100B remain in the closed position, thereby providing fluid communication between production zone 5C of formation 4 and passage 13 of casing string 12 while fluid communication is restricted between production zones 5A, 5B and passage 13 of casing string 12. Following the opening of third sliding sleeve valve 100C by dart 200, stimulation fluid may be pumped through passage 13 of casing string 12 from rig 30 and into production zone 5C via ports 112 of third sliding sleeve valve 100C to thereby stimulate production zone 5C of formation 4. Additionally, in some embodiments, once production zone 5C has been stimulated, a second dart 200 (not shown in FIGS. 1, 2) may be pumped into passage 13 of casing string 12 to actuate the second sliding sleeve valve 100B from the closed position to the open position to thereby facilitate the stimulation of production zone 5B of formation 4. Production zone 5A of formation 4 may similarly be stimulated by pumping a third dart 200 into passage 13 of casing string that is configured to land within and actuate first sliding sleeve valve 100A from the closed position to the open position. Although in this embodiment the first dart 200 is configured to actuate third sliding sleeve valve 100C into the open position, in other embodiments, the first dart 200 may be configured to actuate either first sliding sleeve valve 100A or second sliding sleeve valve 100B into the open position.

Referring to FIGS. 1-7, an embodiment of sliding sleeve valve 100C of the completion system 10 of FIGS. 1, 2 is shown in FIGS. 3-7. Sliding sleeve valve 100C has a longitudinal or central axis 105 and generally includes an outer housing 102, sliding sleeve 140 slidably disposed in housing 102, and a protective sleeve 180 disposed in housing 102. Housing 102 of sliding sleeve valve 100C comprises a first or upper end 104, a second or lower end 106, a central bore or passage 108 defined by a generally cylindrical inner surface 110 extending between ends 104, 106. In the embodiment of FIGS. 3-7, housing 102 comprises a plurality of tubular sections 102A, 102B, and 102C, each coupled together via a plurality of releasable or threaded connectors 114 located therebetween; however, in other embodiments, housing 102 may comprise a single, unitary tubular member extending between ends 104, 106. Additionally, in this embodiment, an annular seal 116 is positioned at the joint formed between each tubular section 102A-102C of housing 102 to restrict fluid communication between passage 108 of housing 102 and the environment surrounding sliding sleeve valve 100C (e.g., subterranean formation 4). Further, in this embodiment, the inner surface 110 of housing 102 includes a releasable connector 114 at each end 104, 106 of housing 102 to couple housing 102 and sliding sleeve valve 100C with casing string 12.

In this embodiment, the inner surface 110 of housing 102 includes an annular first or upper shoulder 118A and an annular second or lower shoulder 118B axially spaced from upper shoulder 118A. Upper shoulder 118A provides a first or upper stop limiting upward travel of sliding sleeve 140 in housing 102 with sleeve 140 contacting or disposed directly adjacent upper shoulder 118A when sliding sleeve valve 100C is in the closed position shown in FIGS. 3-7. Additionally, the inner surface 110 of housing 102 includes an annular engagement shoulder 117 located proximal to the connector 114 at upper end 104. Lower shoulder 118B provides a second or lower stop limiting downward travel of sliding sleeve 140 in housing 102 with sleeve 140 contacting or disposed directly adjacent lower shoulder 118A when sliding sleeve valve 100C is in the open position. As described above, sliding sleeve valve 100C includes a port 112. Particularly, housing 102 of sliding sleeve valve 100C includes a plurality of circumferentially spaced, axially extending ports 112, each port 112 extending between inner surface 110 and an outer surface of housing 102. Ports 112 are axially located between shoulders 118A, 118B.

In this embodiment, housing 102 also includes a plurality of circumferentially spaced guide pins 120, each guide pin 120 extending radially inwards into passage 108 from inner surface 110. As will described further herein, guide pins 120 restrict relative rotation between sliding sleeve 140 and housing 102. Although in this embodiment housing 102 includes guide pins 120, in other embodiments, housing 102 of sliding sleeve valve 100C may not include pins 120. Additionally, in this embodiment, inner surface 110 of housing 102 includes a plurality of circumferentially spaced shear members or pins 122 each extending radially inwards into passage 108 of housing 102. As will be discussed further herein, shear pins 122 are configured to prevent sliding sleeve 140 from inadvertently actuating or travelling through housing 102 from the closed position to the open position. Further, in this embodiment, inner surface 110 of housing 102 includes an annular second retainer or retaining groove 124 located proximal lower shoulder 118B. Retaining groove 124 is configured to retain sliding sleeve 140 in the open position once sliding sleeve valve 100C has been actuated by a dart 200.

Sliding sleeve 140 of sliding sleeve valve 100C has a first or upper end 140A, a second or lower end 140B, a central bore or passage 142 defined by a generally cylindrical inner surface 144 extending between ends 140A, 140B, and a generally cylindrical outer surface 146 extending between ends 140A, 140B. In this embodiment, sliding sleeve 140 includes a pair of axially spaced annular seals 148 disposed on outer surface 146. Particularly, annular seals 148 are disposed proximal to or adjacent each axial end of radial ports 112. In this arrangement, annular seals 148 seal passage 142 of sliding sleeve 140 from ports 112 and the environment surrounding sliding sleeve valve 100C when sliding sleeve 140 is in the closed position. Sliding sleeve 140 also includes a plurality of axially extending and circumferentially spaced slots 150 disposed on outer surface 146, where each slot 150 receives a corresponding guide pin 120 to thereby restrict relative rotation between housing 102 and sliding sleeve 140. In this embodiment, the outer surface 146 of sliding sleeve 140 also includes an annular retaining groove 151 located proximal the lower ends of slots 150.

In the closed position of sliding sleeve 140 shown in FIGS. 3-7, retaining groove 151 receives a radially inner end of each shear pin 122 of housing 102. Engagement or interference between shear pins 122 and the annular shoulders defining retaining groove 151 maintain sliding sleeve 140 in the closed position until sliding sleeve 140 is actuated by a dart 200. In this embodiment, the outer surface 146 of sliding sleeve 140 further includes a radially outwards biased first or outer retainer ring 152 located proximal to lower end 140B of sliding sleeve 140. As will be discussed further, outer retainer ring 152 expands radially outwards into retaining groove 124 of housing 102 when sliding sleeve 140 is disposed in the open position to retain sliding sleeve 140 in the open position.

In this embodiment, the inner surface 144 of sliding sleeve 140 includes a configurable engagement profile 154 comprising a plurality of axially spaced annular coding grooves 156A-156H, where one or more of coding grooves 156A-156H may receive a blocking ring or member 158. Particularly, in this embodiment, coding grooves 156A, 156C, 156E, and 156G of the sliding sleeve 140 of sliding sleeve valve 100C receive blocking rings 158; however, as will be described further herein, blocking rings 158 may be sequenced in any particular order (including receiving zero blocking rings 158 in coding grooves 156A-156H) in engagement profile 154. Additionally, although in this embodiment engagement profile 154 of the sliding sleeve 140 of sliding sleeve valve 100C includes eight coding grooves 156A-156H, in other embodiments, engagement profile 154 may include varying numbers of coding grooves 156. In some embodiments, blocking rings 158 may be coupled to their respective coding grooves 156A-156H via a fastener or adhesive. In other embodiments, blocking rings 158 may be molded to their respective coding grooves 156A-156H. In this embodiment, engagement profile 154 of the sliding sleeve 140 of sliding sleeve valve 100C includes a first or upper protective groove 160A, a second or lower protective groove 160B axially spaced from upper protective shoulder 160A, and a locking groove 162 disposed between protective grooves 160A, 160B. Further, the inner surface 144 of sliding sleeve 140 includes a radially inwards biased second or inner retaining ring 164 located at the lower end 140B of sliding sleeve 140 for retaining the protective sleeve 180 following the actuation of sliding sleeve 140 from the closed position to the open position, as will be discussed further herein.

In this embodiment, protective sleeve 180 of sliding sleeve valve 100C has a first or upper end 182, a second or lower end 184 axially spaced from upper end 182, a central bore or passage defined by a generally cylindrical inner surface extending between ends 182, 184, and a generally cylindrical outer surface 186 extending between ends 182, 184. The upper end 182 of protective sleeve 180 defines an annular shoulder 182 of protective sleeve 180. Protective sleeve 180 protects the coding grooves 156A-156H of sliding sleeve 140 that do not receive a blocking ring 158 (e.g., coding grooves 156A, 156C, 156E, and 156G in this embodiment) from becoming partially filled or blocked by particulates (e.g., cement slurry) entrained in fluid flowing through passage 142 of sliding sleeve 140. Protective sleeve 180 includes a first position in housing 102 (shown in FIGS. 1-7) where the lower end 184 of protective sleeve 180 is disposed directly adjacent or contacts a shear member or ring 190 coupled to the inner surface 110 of housing 102 and a second or lower position (shown in FIGS. 13, 14) that is axially spaced from the upper position. Prior to being actuated by dart 200, protective sleeve 180 is retained in the first position by shear ring 190. Protective sleeve 180 is actuated into the second position as the sliding sleeve 140 following the pumping of dart 200 through passage 13 of casing string 12. Following the actuation of protective sleeve 180 into the second position, protective sleeve 180 is retained in the second position by the inner retaining ring 164 of sliding sleeve 140, which is received in an annular groove 188 formed in the outer surface 186 of protective sleeve 180. Although in this embodiment sliding sleeve valve 100C includes protective sleeve 180, other embodiments of sliding sleeve valve 100C need not include sleeve 180.

Referring to FIGS. 8-11, an exemplary embodiment of a dart 200 of the completion system 10 of FIGS. 1, 2 is shown. In this instance, dart 200 generally includes a central body or collet 202, an upper cap or nose 260, and an entry guide 280. Collet 202 has a first or upper end 202A, a second or lower end 202B axially spaced from upper end 202A, a central bore or passage 204 defined by a generally cylindrical inner surface extending between ends 202A, 202B, and a generally cylindrical outer surface 206 extending between ends 202A, 202B. The inner surface of collet 202 includes a pair of releasable or threaded connectors 208 disposed at ends 202A, 202B of collet 202 for coupling collet 202 with nose 260 and entry guide 280. Collet 202 of dart 200 includes a pair of axially spaced annular seals 210 disposed on outer surface 206 and located proximal to the upper end 202A of collet 202. As will be discussed further herein, seals 210 of collet 202 are configured to sealingly engage the inner or sealing surface 144 of sliding sleeve 140 to restrict fluid flow between upper end 104 and lower end 106 of housing 102.

In the embodiment of FIGS. 8-11, collet 202 includes a plurality of axially extending, circumferentially spaced collet fingers 212 configured to selectively engage the engagement profile 154 of one of the sliding sleeve valves 100A-100C of casing string 12. In this embodiment, each collet finger 212 includes a first or upper protective shoulder 214A, a second or lower protective shoulder 214B axially spaced from upper protective shoulder 214A, and a locking shoulder 216 located between protective shoulders 214A, 214B, where shoulders 214A, 214B, and 216 each extend radially outwards from the collet finger 212. Additionally, as shown particularly in FIG. 11, each collet finger 212 of collet 202 includes a plurality of arcuately extending keyways 218A-218H. One or more of keyways 218A-218H may receive an arcuate key 220 at least partially therein. Particularly, in this embodiment, keyways 218B, 218D, 218F, and 218H of the collet fingers 212 of collet 202 receive keys 220; however, keys 220 may be sequenced in any particular order. Keys 220 are secured within their respective keyways 218A-218H via retaining members or plates 222 that extend axially along each edge of each collet finger 212, where retaining plates 222 are releasably coupled to collet fingers 212 via releasable or threaded fasteners 224. In this configuration, keys 220 may be removed from their respective keyways 218A-218H to be sequenced in a different arrangement by releasing fasteners 224 and retaining plates 222 from collet fingers 212. Thus, a single dart 200 including a finite number of keyways 218 and corresponding keys 220 may provide a large number of potential sequences or combinations of keys 220 and keyways 218. For instance, in this embodiment, where collet 202 of dart 200 includes eight keyways 218, 256 distinct codes or sequences of keys 220 may be provided. Although in this embodiment retaining plates 222 and corresponding fasteners 224 are used to secure keys 220 to collet fingers 212, in other embodiments, other mechanisms may be used to retain keys 220 to collet fingers 212, including permanently coupling keys 220 to collet fingers 212.

Nose 260 of dart 200 is configured to restrict fluid flow through passage 204 of collet 202 as dart 200 is pumped through passage 13 of casing string 12. In this embodiment, nose 260 includes a releasable or threaded connector 262 coupled with the threaded connector 208 of collet 202. In this embodiment, entry guide 280 includes a releasable or threaded connector 282 coupled with the threaded connector 208 of collet 202. In other embodiments, other mechanisms may be used to couple nose 260 and entry guide 280 with collet 202. Additionally, entry guide 280 includes an annular shoulder 284 at a lower end thereof to guide dart through passage 13 of casing string 12 such that dart does not inadvertently snare or catch against a surface within casing string 12 prior to reaching its intended destination within string 12. In this embodiment, each of nose 260 and entry guide 280 comprise a dissolvable material to maximize the flow area through indexing tool (via passage 204 of collet 202) following the actuation of the sliding sleeve valve 100A-100C by the dart 200 and the subsequent stimulation of the production zone 5A-5C disposed adjacent the sliding sleeve valve 100A-100C. In some embodiments, nose 260 and entry guide 280 may comprise chloride containing solutions; however, in other embodiments, nose 260 and entry guide 280 may comprise other materials (e.g., bromide containing solutions, etc.) configured to dissolve in response to exposure to particular environmental conditions, including temperature, pH, and the presence of particular chemicals or compounds.

Referring generally to FIGS. 1, 2, 7, 11, and 12-16, a dart (such as dart 200 described with respect to FIGS. 8-16) is configured to pass through sliding sleeve valves 100A, 100B, and to actuate the sliding sleeve 140 of sliding sleeve valve 100C from the closed position to the open position. Particularly, keys 220 of dart 200 are sequenced or coded (e.g., forming a first coded sequence) to permit collet fingers 212 to matingly engage the engagement profile 154 of the sliding sleeve 140 of sliding sleeve valve 100C while not matingly engaging the engagement profiles 154 of sliding sleeve valves 100A, 100B. With keys 220 sequenced such that collet fingers 212 of dart 200 matingly engage engagement profile 154 of sliding sleeve valve 100C, dart 200 is configured to land against and matingly engage the sliding sleeve 140 of sliding sleeve valve 100C to thereby actuate the sliding sleeve 140 from the closed position to the open position. Additionally, blocking rings 158 of the sliding sleeves 140 of sliding sleeve valves 100A, 100B are sequenced or coded such that collet fingers 212 of dart 200 are prevented from matingly engaging the engagement profile 154 of sliding sleeve valves 100A, 100B, thereby preventing dart 200 from actuating the sliding sleeve 140 of either sliding sleeve valve 100A or 100B as dart 200 is pumped through passage 13 of casing string 12.

Figure 12:
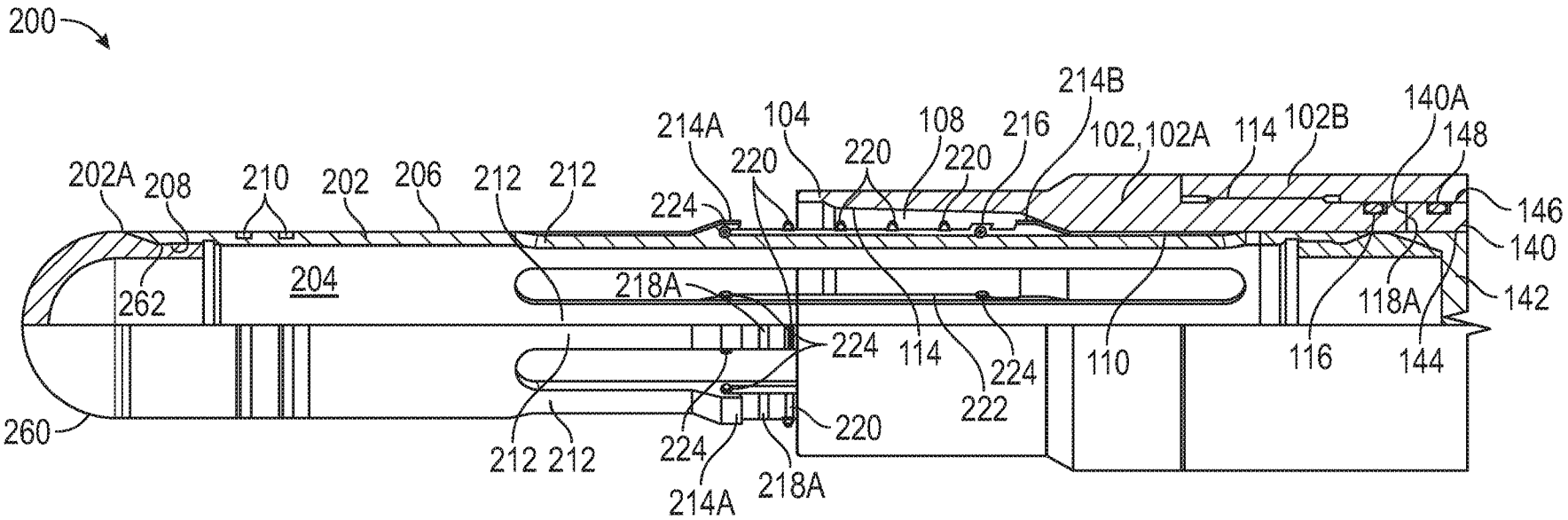
FIG. 12 is a side cross-sectional view of the sliding sleeve valve of FIG. 8 and the dart of FIG. 8 in a first position.
Figure 13:
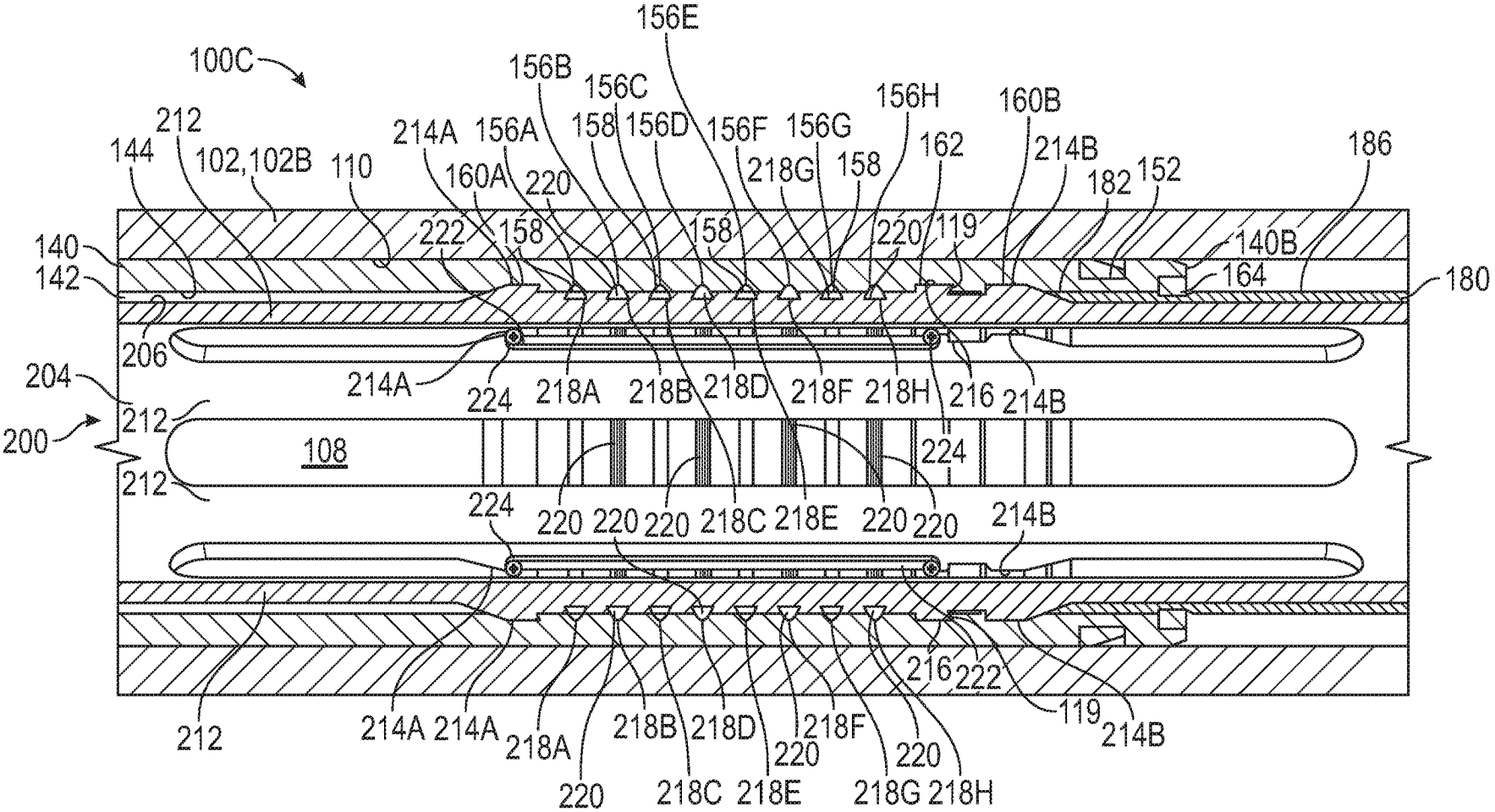
FIG. 13 is a side cross-sectional view of the sliding sleeve valve of FIG. 8 and the dart of FIG. 8 in a second position.
Figure 14:
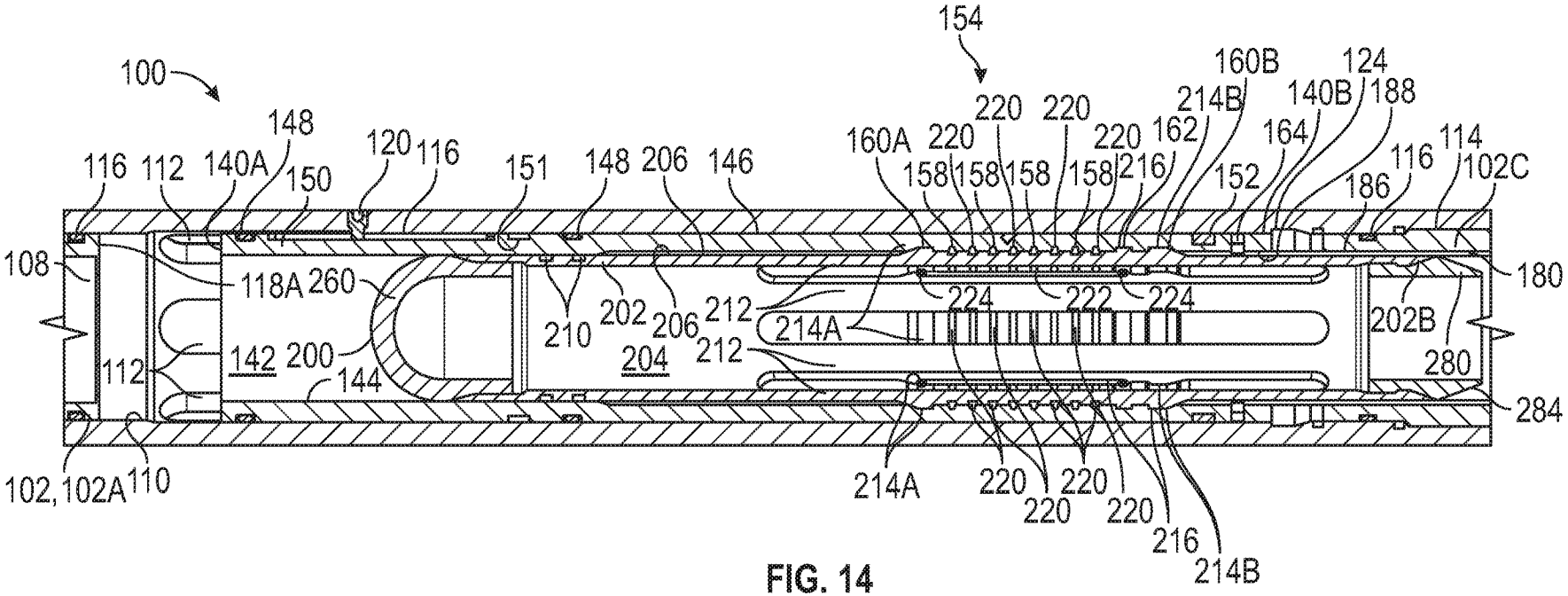
FIG. 14 is a side cross-sectional view of the sliding sleeve valve of FIG. 8 and the dart of FIG. 8 in a third position.
Figure 15:
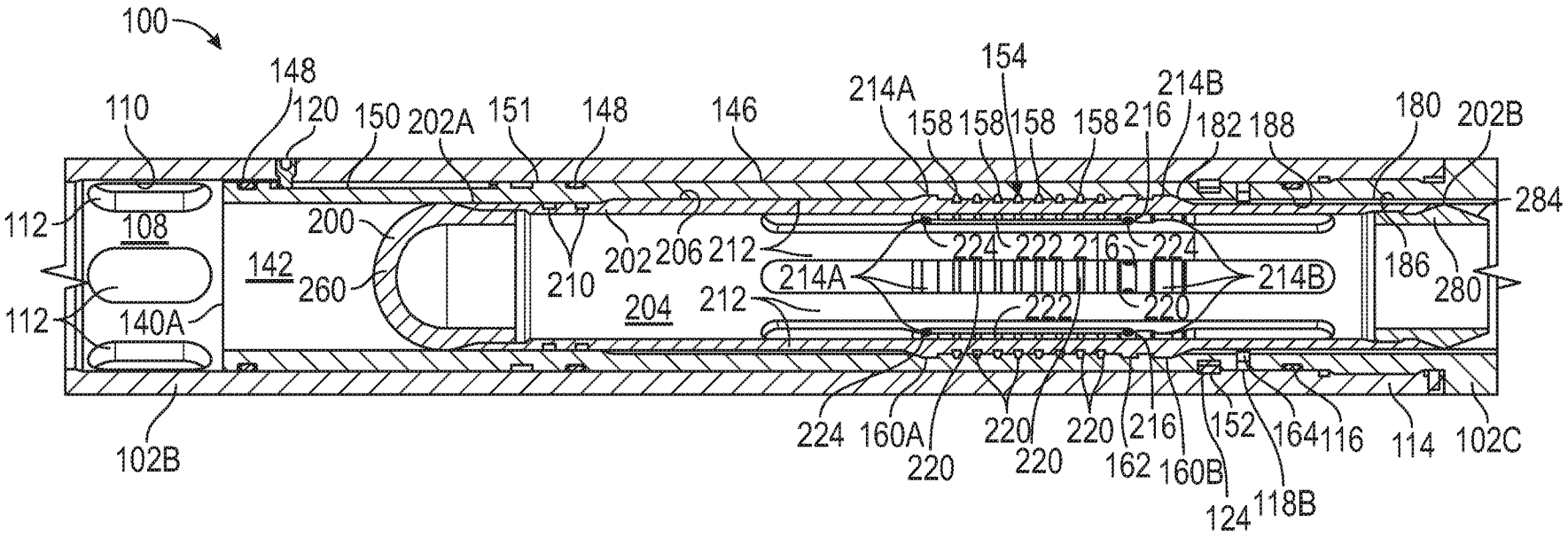
FIG. 15 is a side cross-sectional view of the sliding sleeve valve of FIG. 8 and the dart of FIG. 8 in a fourth position.

After passing through sliding sleeve valves 100A, 100B, dart 200 is pumped through passage 13 of casing string 12, dart 200 enters passage 108, of the housing 102 of sliding sleeve valve 100C, as shown particularly in FIG. 12. As dart 200 enters passage 108, the protective shoulder 214B of each collet 212 of dart engages the engagement shoulder 117 of housing 102, thereby forcing or flexing each collet finger 212 radially inwards towards central axis 105 of sliding sleeve valve 100C. In this manner, proactive shoulder 214B of each collet 212 protects or guides collet fingers 212 through passage 142 of sliding sleeve 140 such that features of collet fingers 212 (e.g., keys 220) do not catch or snag on features of casing string 12, including engagement shoulder 117 of housing 102. With collet fingers 212 flexed radially inwards, dart 200 is permitted to travel into passage 142 of sliding sleeve 140 of the sliding sleeve valve 100C. As shown particularly in FIG. 13, as dart 200 enters passage 142 of sliding sleeve 140, the lower protective shoulder 214B of each collet finger 212 physically engages the upper end 182 of protective sleeve 180, thereby shearing the shear ring 190 retaining protective sleeve 180 in the upper position. Having sheared the shear ring 190, dart 200 forces protective sleeve 180 axially through passage 142 of sliding sleeve 140 into the lower position as dart 200 travels through passage 142. Additionally, although FIG. 13 illustrates dart 200 actuating the protective sleeve 180 of sliding sleeve valve 100C, the same action is performed by dart 200 as it passes through sliding sleeve valves 100A, 100B. In other words, as dart 200 passes through sliding sleeve valve 100A, the lower protective shoulder 214B of each collet finger 212 forces the protective sleeve 180 of sliding sleeve valve 100A into the lower position. Similarly, as dart 200 continues through casing string 12 passing into sliding sleeve valve 100B, the lower protective shoulder 214B of each collet finger 212 forces the protective sleeve 180 of sliding sleeve valve 100B into the lower position. Thus, as dart 200 is pumped through casing string 12, dart 200 actuates the protective sleeve 180 of each sliding sleeve valve 100A, 100B, and 100C into the lower position.

Dart 200 continues to travel through passage 142 of sliding sleeve 140 until collet fingers 212 axially align with engagement profile of sliding sleeve 140, thereby permitting collet fingers 212 to expand radially outward and matingly engage the engagement profile 154 of sliding sleeve 140. Particularly, with keys 220 disposed in keyways 218B, 218D, 218F, and 218H, and with coding grooves 156B, 156D, 156F, and 156H being free of blocking rings 158 (blocking rings 158 being received, instead, in coding grooves 156A, 156C, 156E, and 156G), keys 220 are permitted to enter and be matingly received in coding grooves 156B, 156D, 156F, and 156H of the engagement profile 154 of sliding sleeve 140. Additionally, upper protective shoulders 214A of collet fingers 212 are permitted to enter upper protective groove 160A of engagement profile 154, lower protective shoulders 214B of collet fingers 212 are permitted to enter lower protective groove 160B of engagement profile 154, and locking shoulders 216 of collet fingers 212 are permitted to enter locking groove 162 of engagement profile 154.

As described above, keys 220 of the collet fingers 212 of dart 200 are sequenced or coded such that they do not match the sequence of the blocking rings 158 of the engagement profiles 154 of sliding sleeve valves 100A, 100B. Particularly, each of sliding sleeve valves 100A, 100B include a blocking ring 158 in at least one of the coding grooves 156A, 156C, 156E, and/or 156G of their respective engagement profiles 154. With at least one blocking ring 158 received in coding grooves 156A, 156C, 156E, and/or 156G, at least one key 220 of each collet finger 212 of the dart 200 is prevented from entering one of the coding grooves 156A, 156C, 156E, and/or 156G of the engagement profile 154 of sliding sleeve valves 100A, 100B. With at least one key 220 of dart 200 being prevented from expanding into engagement with a corresponding groove 156A, 156C, 156E, and/or 156G, collet fingers 212 are prevented from radially expanding into mating engagement with either the engagement profile 154 of sliding sleeve valve 100A or the engagement profile 154 of sliding sleeve valve 100B. Given that collet fingers 212 of dart 200 are prevented from expanding into mating engagement with the engagement profiles 154 of sliding sleeve valves 100A, 100B, dart 200 does not become axially locked to the sliding sleeves 140 of sliding sleeve valves 100A, 100B and is, instead, permitted to pass through both sliding sleeve valves 100A, 100B.

With collet fingers 212 radially expanded into mating engagement with the engagement profile 154, dart 200 is axially locked to sliding sleeve 140 such that relative axial movement between sliding sleeve 140 and dart 200 is restricted. In this arrangement, fluid may continue to be pumped into passage 13 of casing string 12 from rig 30 to apply a pressure induced axial force against an upper end of dart 200. The pressure force applied to the upper end of dart 200 is transmitted to sliding sleeve 140 via the mating engagement between the locking shoulders 216 of collet fingers 212 and the locking grooves 162 of engagement profile 154 of sliding sleeve 140, causing retaining shoulder 151 of sliding sleeve 140 to shear the shear pins 122 of housing 102 (via the contact therebetween), as shown particularly in FIG. 14. Having sheared the shear pins 122 of housing 102, sliding sleeve 140 is axially unlocked from housing 102 of sliding sleeve valve 100C such that sliding sleeve 140 may travel axially relative to housing 102. Thus, following the shearing of shear pins 122, the pressure force applied to the upper end of dart 200 forces dart 200 and sliding sleeve 140 axially downwards through passage 108 of housing 102 until the lower end 140B contacts lower shoulder 118B of housing 102, which arrests the downward travel of both sliding sleeve 140 and dart 200 through passage 108, as shown particularly in FIG. 15.

With the lower end 140B of sliding sleeve 140 disposed directly adjacent or contacting lower shoulder 118B of housing 102, sliding sleeve 140 has fully actuated into the open position with both seals 148 of sliding sleeve 140 being positioned downhole from ports 112 of housing 102. In this arrangement, stimulation fluid may be pumped through passage 13 of casing string 12 from rig 30. The stimulation fluid pumped from rig 30 is restricted from flowing around dart 200 to the toe 24 of wellbore 20 by the seal formed between seals 210 of dart 200 and the inner surface 144 of sliding sleeve 140. Thus, the stimulation fluid pumped from rig 30 is forced through ports 112 of sliding sleeve valve 100C and into the subterranean formation 4 to stimulate production zone 5C of formation 4.

Figure 16:
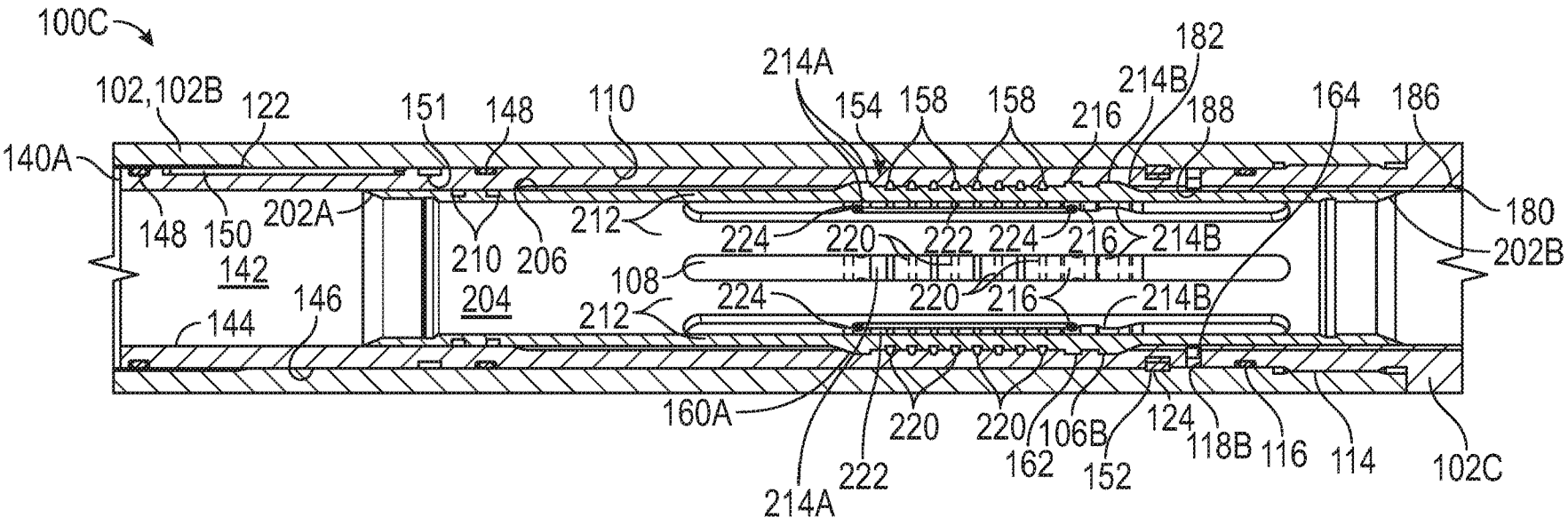
FIG. 16 is a side cross-sectional view of the sliding sleeve valve of FIG. 8 and the dart of FIG. 8 in a fifth position.

At some point following the simulation of each production zone 5A-5C of formation 4, the dissolvable materials comprising nose 260 and entry guide 280 dissolve, as shown particularly in FIG. 16 to allow formation fluids from formation 4 to be produced from production zone 5C to the surface of wellbore 20. In this embodiment, nose 260 and entry guide 280 dissolve following exposure to a predetermined temperature for a predetermined of time configured to allow for sufficient time to stimulate production zone 5C prior to the dissolution of nose 260 and entry guide 280; however, as described above, in other embodiments nose 260 and entry guide 280 may be formed from materials configured to dissolve in response to exposure to environmental conditions other than elevated temperatures, including temperature, pH, and the presence of particular catalytic agents.

Following the stimulation of production zone 5C of formation 4, a second dart 200 may be pumped through passage 13 of casing string 12 towards sliding sleeve valve 100B. As the second dart 200 is pumped through casing string 12, the initial dart 200 shown in FIGS. 8-16 is held axially locked to the sliding sleeve 140 of sliding sleeve valve 100C by the locking engagement formed between the locking shoulder 216 of each collet finger 212 of dart 200 and the locking groove 162 of the housing 102 of sliding sleeve valve 100C. Specifically, an angled or locking interface 119 formed between each locking shoulder 216 and the locking groove 162 prevents dart 200 from becoming axially unlocked from the sliding sleeve 140 of sliding sleeve valve 100C. Locking interface 119 is configured such that forcible contact between a lower engagement surface of each locking shoulder 216 and the locking groove 162 of sliding sleeve 140 does not produce a radially inwards directed force against collet fingers 212 such that collet fingers 212. Thus, hydraulic pressure sufficient for stimulating production zone 5C of formation 4 applied against the upper end of dart 200 will not force collet fingers 212 out of mating engagement with the engagement profile 154 of sliding sleeve valve 100C.

In this embodiment, keys 212 of the second dart 200 are sequenced so as to not correspond with the sequencing of the blocking rings 158 of the engagement profile 154 of sliding sleeve valve 100A. In this arrangement, collet fingers 212 of the second dart 200 are prevented from matingly engaging the engagement profile 154 of sliding sleeve valve 100A, permitting the second dart 200 to pass through sliding sleeve valve 100A and continue travelling through passage 13 of casing string 12 towards sliding sleeve valve 100B. In this embodiment, keys 212 of the second dart 200 pumped into and through passage 13 of casing string 12 are sequenced or coded (e.g., forming a second coded sequence) to correspond with the sequencing or coding of the blocking rings 158 of the engagement profile 154 of sliding sleeve valve 100B. For instance, in an embodiment, the engagement profile 154 of sliding sleeve valve 100B may include blocking rings 158 received in coding grooves 156B, 156C, 156E, and 156G, while keys 212 of each collet finger 212 of the second dart 200 may be located in keyways 218A, 218D, 218F, and 218H to thereby permit collet fingers 212 to matingly engage engagement profile 154 of sliding sleeve valve 100B. Similar to the operation of the first dart 200 and sliding sleeve valve 100C described above, with collet fingers 212 of the second dart 200 in mating engagement with the engagement profile 154 of sliding sleeve valve 100B, the sliding sleeve 140 of valve 100B may be actuated from the closed position to the open position to allow for the stimulation of the production zone 5B of subterranean formation 4.

In this embodiment, the second dart 200 remains locked to the sliding sleeve 140 of sliding sleeve valve 100B via the locking interface 119 formed between the locking shoulder 216 of each collet finger 212 of the second dart 200 and the locking groove 162 of the sliding sleeve 140 of sliding sleeve valve 100B. As with the first dart 200, the nose 260 and entry guide 280 of the second dart 200 eventually dissolve to allow formation fluid from formation 4 to be produced from production zone 5B to the surface of wellbore 20. Following the stimulation of production zone 5B, a third dart 200 may be pumped through passage 13 of casing string 12 towards sliding sleeve valve 100A. In this embodiment, keys 212 of the third dart 200 pumped into and through passage 13 of casing string 12 are sequenced or coded (e.g., forming a third coded sequence) to correspond with the sequencing or coding of the blocking rings 158 of the engagement profile 154 of sliding sleeve valve 100A. For instance, in an embodiment, the engagement profile 154 of sliding sleeve valve 100A may include blocking rings 158 received in coding grooves 156A, 156C, 156E, and 156H, while keys 212 of each collet finger 212 of the third dart 200 may be located in keyways 218A, 218D, 218F, and 218G to thereby permit collet fingers 212 to matingly engage engagement profile 154 of sliding sleeve valve 100A.

Similar to the operation of the first and second darts 200 and sliding sleeve valves 100B, 100C described above, with collet fingers 212 of the third dart 200 in mating engagement with the engagement profile 154 of sliding sleeve valve 100A, the sliding sleeve 140 of valve 100A may be actuated from the closed position to the open position to allow for the stimulation of the production zone 5A of subterranean formation 4. In this embodiment, the third dart 200 remains locked to the sliding sleeve 140 of sliding sleeve valve 100B via the locking interface 119 formed between the locking shoulder 216 of each collet finger 212 of the third dart 200 and the locking groove 162 of the sliding sleeve 140 of sliding sleeve valve 100A. As with the first and second darts 200, the nose 260 and entry guide 280 of the third dart 200 eventually dissolve to allow formation fluid from formation 4 to be produced from production zone 5A to the surface of wellbore 20.

Although in the embodiment described above each sliding sleeve valve 100A-100C includes a uniquely sequenced or coded engagement profile 154 (e.g., a uniquely sequenced or coded arrangement of blocking rings 158 in coding grooves 156A-156H), in other embodiments, several of the sliding sleeve valves 100A-100C may share the same sequencing or coding of their respective engagement profiles 154 to allow a single indexing dart 200 to actuate the sliding sleeve 140 from the closed position to the open position of multiple sliding sleeve valves 100A-100C in a single trip of the single dart 200 through the passage 13 of casing string 12.

For instance, in an embodiment, the engagement profile 154 of each of sliding sleeve valves 100A-100C may include the same sequencing or coding of blocking rings 158. In this alternative embodiment, the locking groove 162 of the sliding sleeve 140 of each of sliding sleeve valves 100A and 100B is not configured or angled to form the locking interface 119 with locking shoulders 216 of the dart 200. In this configuration, although the locking shoulders 216 of collet fingers 212 may matingly engage with the locking grooves 162 of engagement profile 154 of each of sliding sleeve valves 100A, 100B to thereby actuate the sliding sleeve 140 of each of sliding sleeve valves 100A, 100B from the closed position to the open position, sufficient hydraulic pressure applied to the upper end of the dart 200 produces a radially inwards directed force against collet fingers 212 of dart 200 sufficient to unlock collet fingers 212 from the engagement profile 154 of sliding sleeve valves 100A, 100B to permit dart 200 to continue to travelling through passage 13 of casing string 12 towards the next sliding sleeve valve 100B or 100C. In this manner, multiple production zones 5A-5C may be stimulated concurrently rather than sequentially, reducing the amount of time required for performing the stimulation of wellbore 20 in at least some applications.

Figure 17:
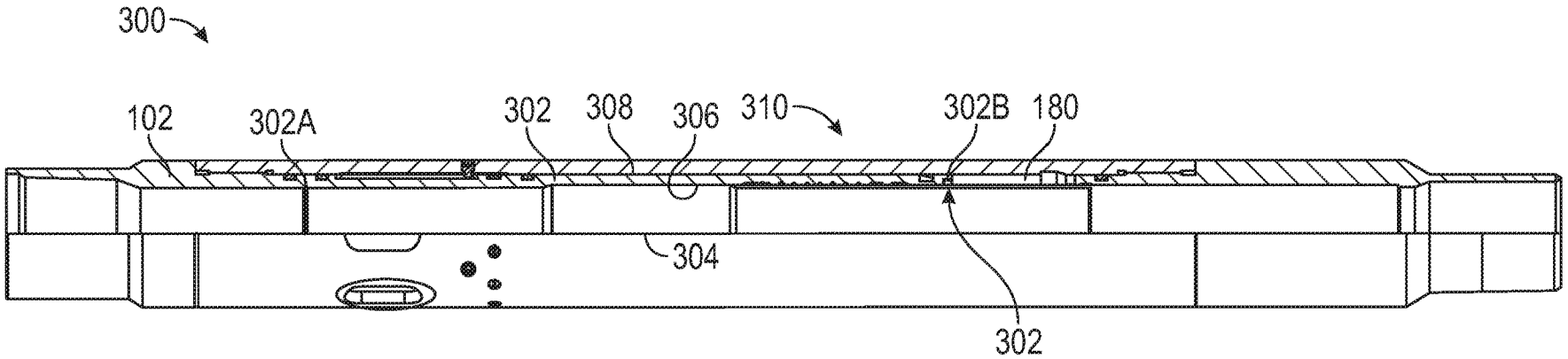
FIG. 17 is a side view of another embodiment of a sliding sleeve valve of the system of FIGS. 1, 2 in accordance with principles disclosed herein.
Figure 18:
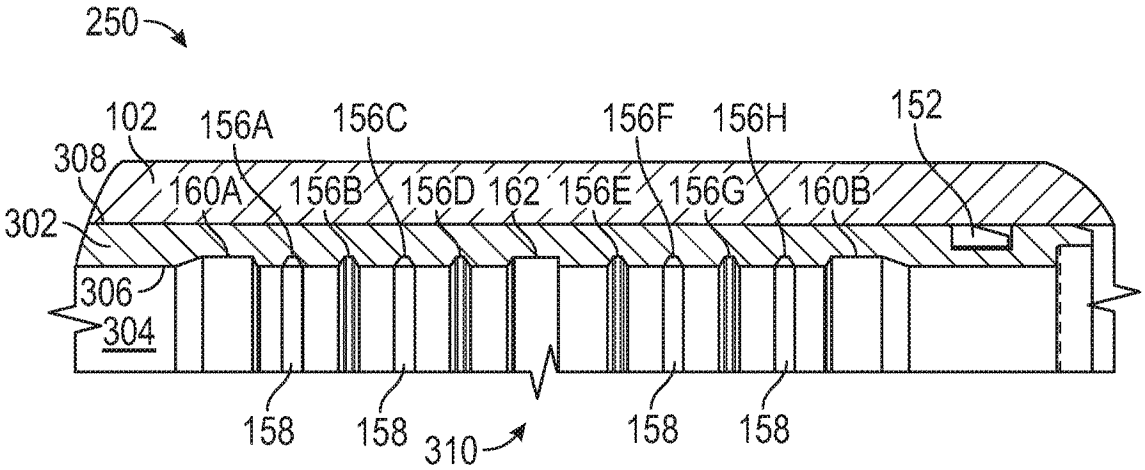
FIG. 18 is a side cross-sectional view of an embodiment of an engagement profile of the sliding sleeve valve of FIG. 17 in accordance with principles disclosed herein.

Referring to FIGS. 17, 18, another embodiment of a sliding sleeve valve 300 of completion system 10 is shown in FIGS. 17, 18. Sliding sleeve valve 300 includes features in common with the sliding sleeve valve 100C shown in FIGS. 3-7, and shared features are labeled similarly. Particularly, sliding sleeve valve 300 includes housing 102, protective sleeve 180, and a sliding sleeve 302. In the embodiment of FIGS. 17, 18, sliding sleeve 302 has a first or upper end 302A, a second or lower end 302B, a central bore or passage 304 defined by a generally cylindrical inner surface 306 extending between ends 302A, 302B, and a generally cylindrical outer surface 308 extending between ends 302A, 302B.

In this embodiment, the inner surface 306 of sliding sleeve 302 includes a configurable engagement profile 310 (shown particularly in FIG. 18) comprising annular coding grooves 156A-156H, upper protective groove 160A, lower protective groove 160B, and locking groove 162. In this embodiment, coding grooves 156A, 156C, 156F, and 156H of the sliding sleeve 140 of sliding sleeve valve 300 receive blocking rings 158; however, blocking rings 158 may be sequenced in any particular order (including receiving zero blocking rings 158 in coding grooves 156A-156H) in engagement profile 310. In this embodiment, locking groove 162 is located axially between coding grooves 156A-156D and coding grooves 156E-156H. In this arrangement, locking groove 162 is located substantially equidistantly between upper protective groove 160A and lower protective groove 160B of engagement profile 310.

Figure 19:
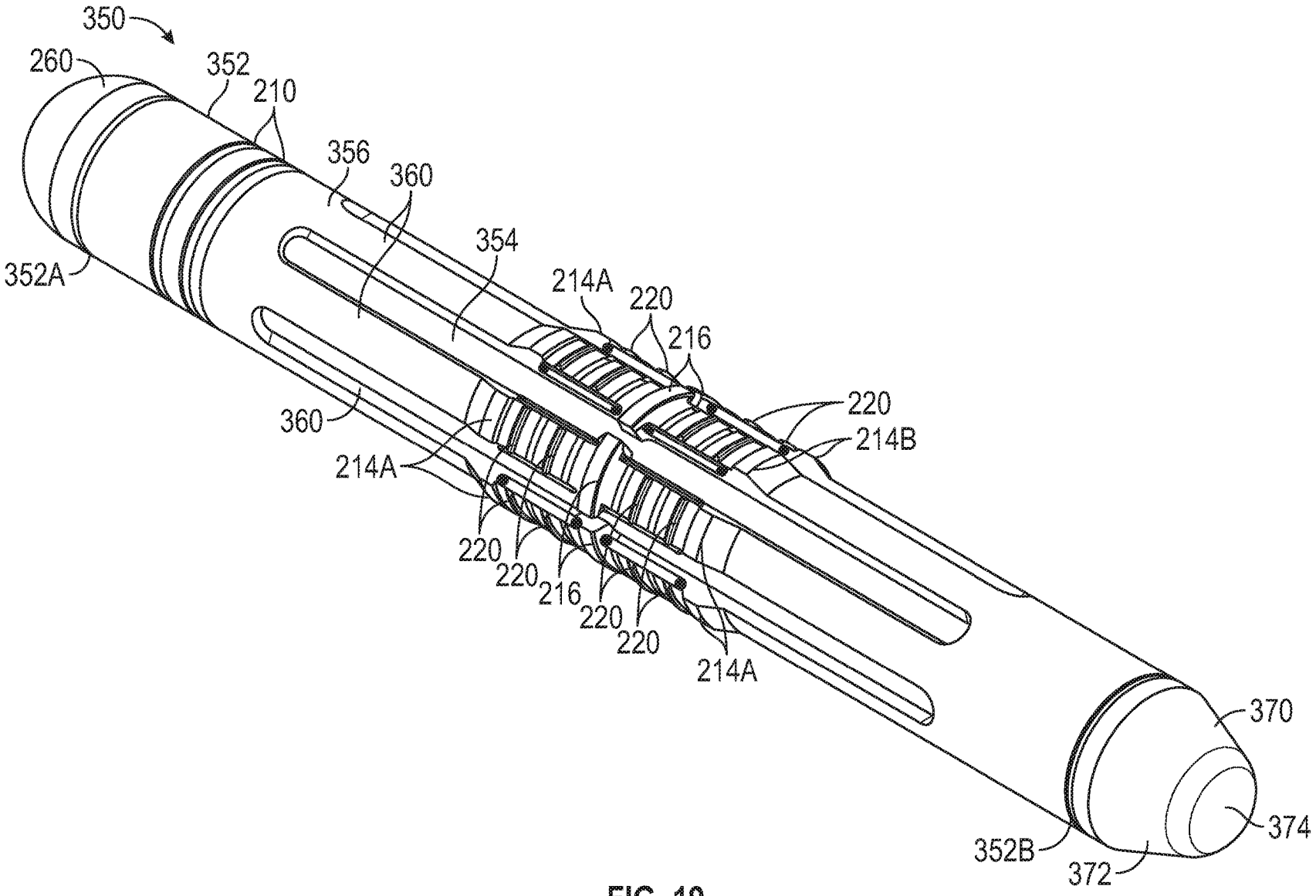
FIG. 19 is a perspective view of another embodiment of a flow transportable dart of the system of FIGS. 1, 2 in accordance with principles disclosed herein.
Figure 20:
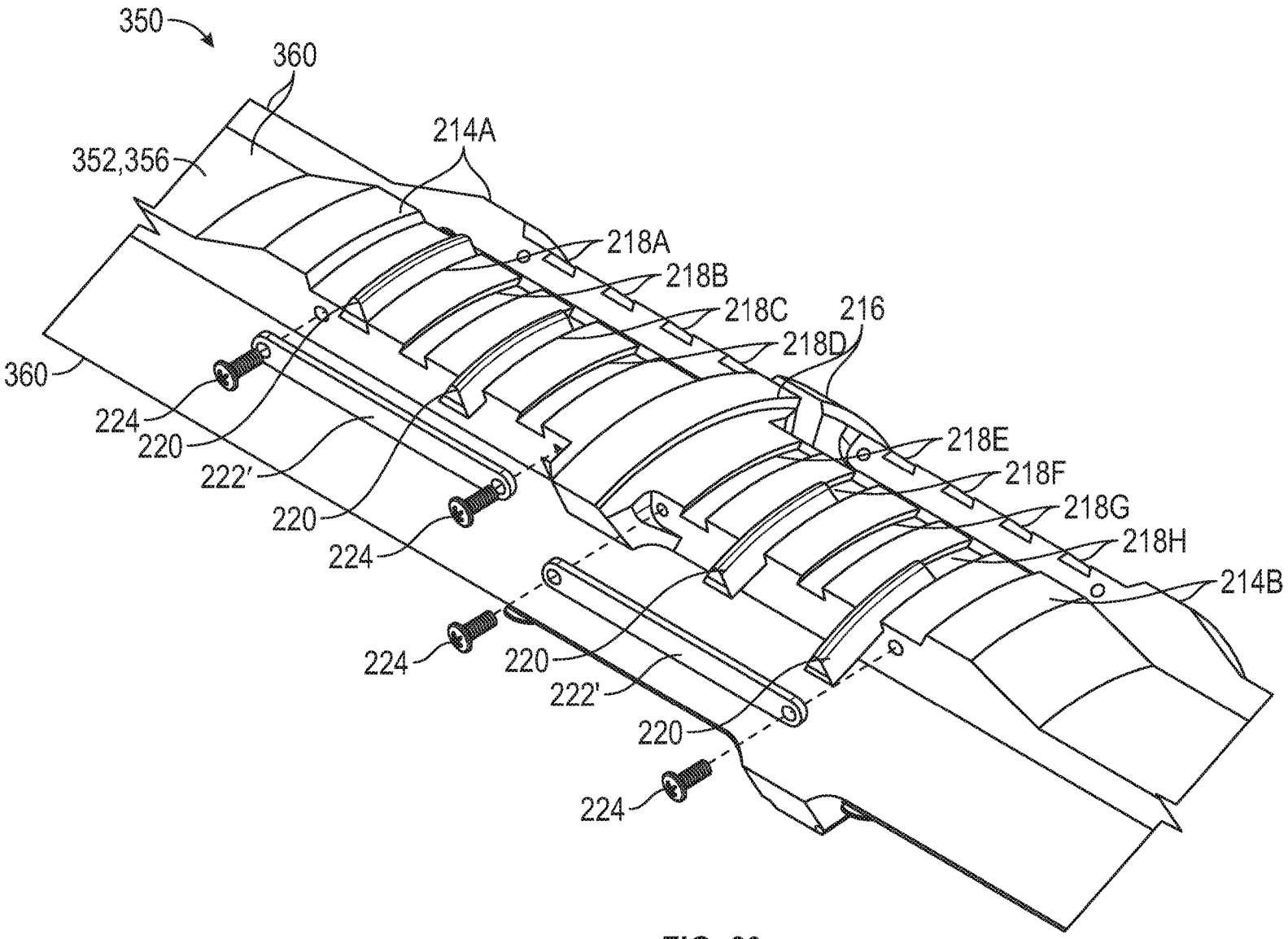
FIG. 20 is a zoomed-in perspective view of an embodiment of a collet finger of the dart of FIG. 19 in accordance with principles disclosed herein.
Figure 21:
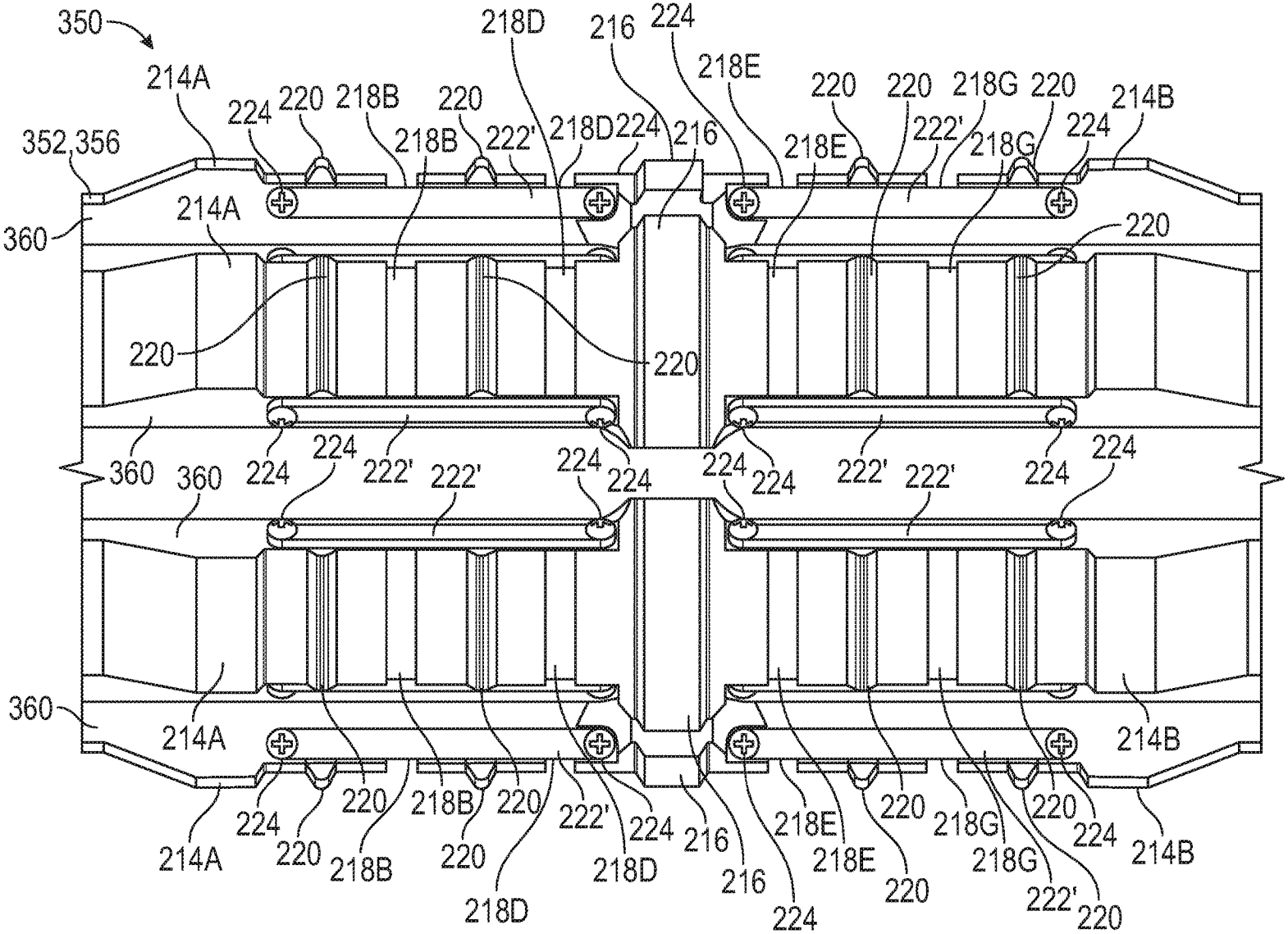
FIG. 21 is a side cross-sectional view of the collet finger of FIG. 20.

Referring to FIGS. 19-21, another embodiment of a dart 350 of completion system 10 is shown in FIGS. 17, 18. Dart 350 includes features in common with the dart 200 shown in FIGS. 8-11, and shared features are labeled similarly. In the embodiment of FIGS. 19-21, dart 350 includes a central body or collet 352, nose 260, and an entry guide or cap 370. Collet 352 has a first or upper end 352A, a second or lower end 352B axially spaced from upper end 352A, a central bore or passage 354 defined by a generally cylindrical inner surface extending between ends 352A, 352B, and a generally cylindrical outer surface 356 extending between ends 352A, 352B. In this embodiment, the inner surface of collet 352 includes a pair of releasable or threaded connectors disposed at ends 352A, 352B for coupling collet 352 with nose 260 and entry guide 370; however, in other embodiments, collet 352 may employ other mechanisms for coupling with nose 260 and entry guide 370.

Collet 352 includes a plurality of axially extending, circumferentially spaced collet fingers 360 configured to selectively engage the engagement profile 310 of the sliding sleeve 302 of sliding sleeve valve 300. In this embodiment, each collet finger 360 (as shown particularly in FIG. 21) includes upper protective shoulder 214A, a lower protective shoulder 214B, and locking shoulder 216. Additionally, each collet finger 360 includes keyways 218A-218H. In this embodiment, keyways 218A, 218C, 218F, and 218H of the collet fingers 360 of collet 352 receive keys 220; however, keys 220 may be sequenced in any particular order. Keys 220 are secured within their respective keyways 218A-218H via retaining plates 222' that are releasably coupled to collet fingers 360 via releasable or threaded fasteners 224.

In this embodiment, locking shoulder 216 is positioned axially between keyways 218A-218D and keyways 218E-218H. Thus, four retaining plates 222' are coupled to each collet finger 360 to retain keys 220 thereto, including a pair of retaining plates 222' extending between upper protective shoulder 214A and locking shoulder 216, and an additional pair of retaining plates 222' extending between locking shoulder 216 and lower protective shoulder 214B. In this arrangement, locking shoulder 216 is positioned substantially equidistantly between upper protective shoulder 214A and lower protective shoulder 214B. Although in this embodiment retaining plates 222' and corresponding fasteners 224 are used to secure keys 220 to collet fingers 360, in other embodiments, other mechanisms may be used to retain keys 220 to collet fingers 360, including permanently coupling keys 220 to collet fingers 360. In this embodiment, entry guide 370 includes a frustoconical outer surface 372 and an enclosed lower end 374. Thus, unlike entry guide 280 shown in FIGS. 8-11, entry guide 370 does not permit fluid flow through lower end 374 into passage 304 of collet 302. Instead, the enclosed end 374 of entry guide 370 directs fluid around dart 350 as dart 350 is pumped through the passage 13 of casing string 12.

Figure 22:
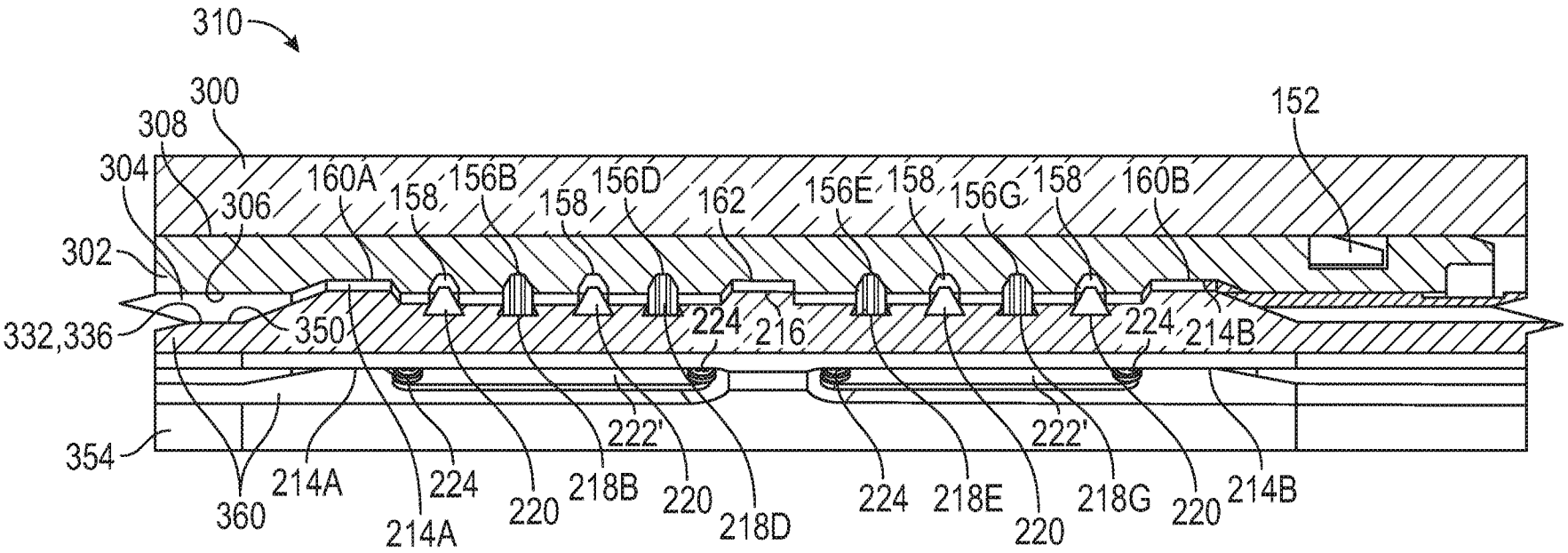
FIG. 22 is a side cross-sectional view of the sliding sleeve valve of FIGS. 17, 18 and the dart of FIGS. 19-21.

Referring to FIG. 22, the dart 350 shown in FIGS. 19-21 is shown engaging the engagement profile 310 of the sliding sleeve valve 300 shown in FIGS. 17, 18. As described above, blocking rings 158 of engagement profile 310 are disposed in the coding grooves 156A, 156C, 156F, and 156H that correspond or match the keyways 218A, 218C, 218F, and 218H of collet fingers 360 that receive keys 220, preventing locking shoulders 216 of collet fingers 360 from flexing radially outwards into mating engagement with locking groove 162 of engagement profile 310. Additionally, the risk of locking shoulders 216 inadvertently snagging and engaging locking groove 162 is reduced given that locking groove 162 is positioned axially towards the middle or center of engagement profile 310 and locking shoulders 216 are positioned axially towards the middle or center of collet fingers 360.

Particularly, when collet fingers 360 are flexed radially inwards (as shown in FIG. 22), the axial center or middle of each collet finger 360 is flexed father inward than the upper and lower ends of each collet finger 360. Thus, by positioning locking shoulders 216 at or near the axial middle of each collet finger 360, locking shoulders 216 are flexed radially inwards a greater extent than if shoulders 216 were positioned proximal the upper or lower ends of collet fingers 360. In this manner, locking shoulders 216 may be radially spaced a greater extent from locking groove 162 when collet fingers 360 are flexed radially inwards to thereby prevent or mitigate the possibility of one or more of the locking shoulders 216 inadvertently snagging against the locking groove 162 of engagement profile 310.

Figure 23:
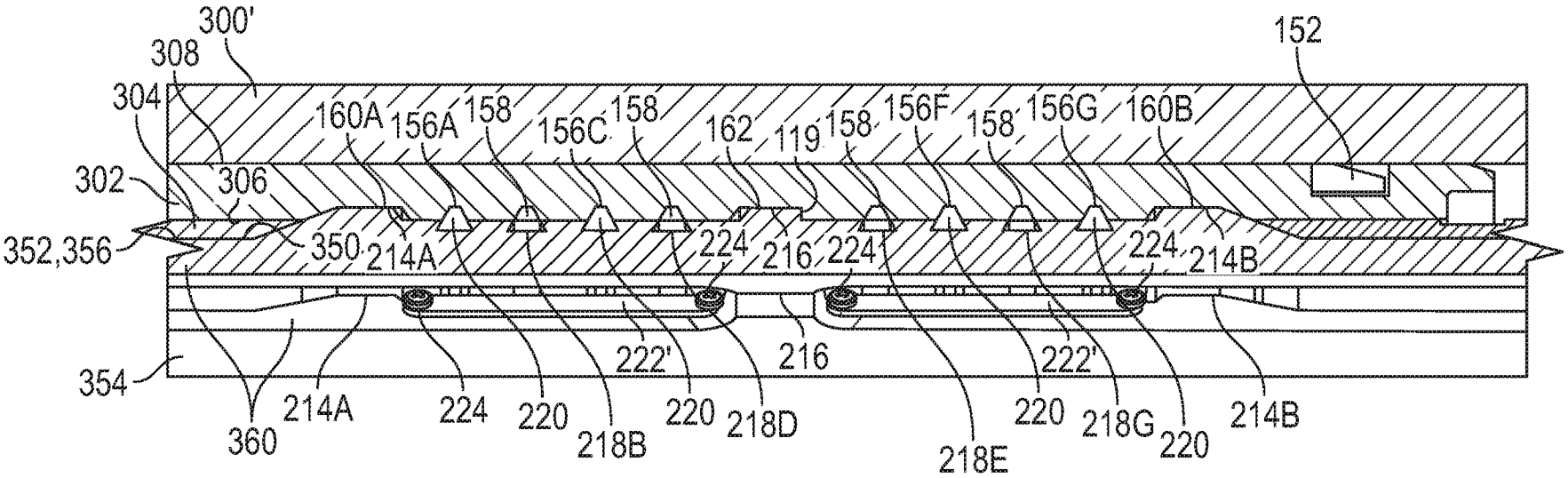
FIG. 23 is a side cross-sectional view of another embodiment of a sliding sleeve valve and the dart of FIGS. 19-21 in accordance with principles disclosed herein.

Referring to FIG. 23, collet fingers 360 of dart 350 are shown engaging the engagement profile 310' of a second sliding sleeve valve 300', where engagement profile 310' does not include blocking rings 158 in coding grooves 156A, 156C, 156F, and 156H. In this arrangement, collet fingers 360 of dart 350 are permitted to radially expand outwards into mating engagement with the engagement profile 310' of a second sliding sleeve valve 300' such that dart 350 may actuate the sliding sleeve 302 of the a second sliding sleeve valve 300' into the open position.

While disclosed embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A system for stimulating an earthen formation, comprising:

a tubular string disposed in a wellbore extending through the formation;

a first valve coupled to the tubular string, the first valve comprising a sliding sleeve having an engagement profile with a first coded sequence comprising a first plurality of coding grooves and at least one first blocking member axially fixed to the sliding sleeve of the first valve and removably received in at least one of the first plurality of coding grooves;

a second valve coupled to the tubular string, the second valve comprising a sliding sleeve having an engagement profile with a second coded sequence that differs from the first coded sequence of the first valve comprising a second plurality of coding grooves and at least one second blocking member axially fixed to the sliding sleeve of the second valve and removably received in at least one of the second plurality of coding grooves; and a first dart flow transportable through the tubular string, the first dart comprising a collet finger having a first coded sequence configured to restrict the collet finger from matingly engaging the engagement profile of the first valve while permitting the collet finger to matingly engage the engagement profile of the second valve;

wherein the first dart is configured to actuate the sliding sleeve of the second valve from a first position to a second position in response to the collet finger of the first dart matingly engaging the engagement profile of the second valve.

2. The system of claim 1, further comprising:

a second dart flow transportable through the tubular string, the second dart comprising a collet finger having a second coded sequence that differs from the first coded sequence of the first dart and configured to permit the collet finger to matingly engage the engagement profile of the first valve;

wherein the second dart is configured to actuate the sliding sleeve of the first valve from a first position to a second position in response to the collet finger of the second dart matingly engaging the engagement profile of the first valve.

3. The system of claim 1, wherein:

the engagement profile of the sliding sleeve of the second valve comprises a locking groove and the collet finger of the first dart comprises a locking shoulder;

the locking groove and the locking shoulder being configured to axially lock the first dart to the sliding sleeve of the second valve after the sliding sleeve of the second valve has actuated to the second position.

4. The system of claim 1, wherein:

a plurality of axially spaced keyways are disposed on an outer surface of the collet finger of the first dart;

at least one key is received in one of the keyways of the collet finger;

the at least one key of the first dart axially overlaps the at least one first blocking member when the keyways of the collet finger of the first dart are axially aligned with the first plurality of coding grooves, preventing mating engagement between the collet finger of the first dart and the engagement profile of the first valve; and the at least one key of the first dart is axially spaced from the at least one second blocking member when the keyways of the collet finger of the first dart are axially aligned with the second plurality of coding grooves, permitting mating engagement between the collet finger of the first dart and the engagement profile of the second valve.

5. The system of claim 4, wherein the first dart comprises:

a pair of elongate retaining members extending along a pair of sides of the collet finger; and a plurality of fasteners releasably coupling the retaining members to the collet finger;

wherein the retaining members releasably couple the at least one key to the collet finger.

6. The system of claim 1, wherein the sliding sleeve of the second valve comprises:

a first protective groove located at a first end of the engagement profile;

a second protective groove located at a second end of the engagement profile opposite the first end; and a locking groove located between the first protective groove and the second protective groove.

7. The system of claim 6, wherein the first dart comprises:

a pair of axially spaced protective shoulders extending radially outward from the collet finger, wherein the protective shoulders are configured to be received in the first and second protective grooves of the sliding sleeve of the second valve; and a locking shoulder extending radially outward from the collet finger, wherein the locking shoulder is located between the pair of protective shoulders, wherein the locking shoulder is configured to be received in the locking groove of the sliding sleeve of the second valve.

8. The system of claim 1, wherein the first dart comprises:

a nose coupled to a first end of a collet;

an entry guide coupled to a second end of the collet opposite the first end, the entry guide configured to guide the dart through the wellbore; and an annular seal disposed on an outer surface of the collet and configured to seal against a sealing surface disposed in the wellbore;

wherein the nose and entry guide are formed from dissolvable materials configured to dissolve in response to a predetermined environmental condition within the wellbore.

9. A sliding sleeve valve for use in a wellbore, comprising:

an outer housing;

a sliding sleeve slidably disposed in the outer housing, the sliding sleeve comprising an engagement profile formed on an inner surface thereof, wherein the engagement profile comprises a plurality of axially spaced coding grooves extending radially into the inner surface of the sliding sleeve; and at least one blocking member configured to be removably received radially within one of the coding grooves of the sliding sleeve;

wherein the engagement profile is configured to form a coded sequence when the at least one blocking member is received in one of the coding grooves of the sliding sleeve; and wherein the sliding sleeve is configured to actuate from a first position to a second position in response to an actuation tool matingly engaging the engagement profile of the sliding sleeve.

10. The sliding sleeve valve of claim 9, wherein the at least one blocking member comprises at least one blocking ring molded to one of the coding grooves of the sliding sleeve.

11. The sliding sleeve valve of claim 9, wherein the engagement profile of the sliding sleeve further comprises:

a first protective groove located at a first end of the engagement profile;

a second protective groove located at a second end of the engagement profile opposite the first end; and a locking groove located between the first protective groove and the second protective groove.

12. The sliding sleeve valve of claim 9, further comprising:

a protective sleeve disposed at least partially in the sliding sleeve;

wherein the protective sleeve has a first position relative to the sliding sleeve covering the coding grooves of the engagement profile and a second position relative to the sliding sleeve axially spaced from the coding grooves.

13. The sliding sleeve valve of claim 9, wherein:

the outer housing comprises a radial port;

the sliding sleeve comprises a pair of annular seals disposed on an outer surface thereof; and the annular seals of the sliding sleeve seal a passage of the outer housing from an environment surrounding the sliding sleeve valve when the sliding sleeve is in the first position and permit fluid communication between the passage of the outer housing and the environment surrounding the sliding sleeve when the sliding sleeve is in the second position.

14. A dart flow transportable through a wellbore, comprising:

a collet;

a collet finger coupled to the collet;

a plurality of axially spaced keyways disposed on an outer surface of the collet finger; and at least one key configured to be received in one of the keyways of the collet finger;

a pair of elongate retaining members extending along a pair of sides of the collet finger; and a plurality of fasteners releasably coupling the retaining members to the collet finger;

wherein the retaining members releasably couple the at least one key to the collet finger wherein the collet is configured such that when the at least one key is received in one of the keyways of the collet finger, the collet finger forms a coded sequence.

15. The dart of claim 14, wherein:

the collet comprises a plurality of the collet fingers which are circumferentially spaced;

each collet finger comprising a plurality of axially spaced keyways disposed on an outer surface of the collet finger;

one keyway of each collet finger receives one of the at least one keys.

16. The dart of claim 14, wherein:

the plurality of keyways of the collet finger comprise arcuate keyways; and the at least one key comprises an arcuate key.

17. The dart of claim 14, further comprising:

a nose coupled to a first end of the collet;

an entry guide coupled to a second end of the collet opposite the first end, the entry guide configured to guide the dart through the wellbore; and an annular seal disposed on an outer surface of the collet and configured to seal against a sealing surface disposed in the wellbore;

wherein the nose and entry guide are formed from dissolvable materials configured to dissolve in response to a predetermined environmental condition within the wellbore.

18. The dart of claim 14, further comprising:

a pair of axially spaced protective shoulders extending radially outward from the collet finger; and a locking shoulder extending radially outward from the collet finger, wherein the locking shoulder is located between the pair of protective shoulders.

* * * * *